US009957665B2

(12) United States Patent
Eagles et al.

(10) Patent No.: US 9,957,665 B2
(45) **Date of Patent: *May 1, 2018**

(54) MULTILAYER BELT FOR CREPING AND STRUCTURING IN A TISSUE MAKING PROCESS

(71) Applicant: Albany International Corp., Rochester, NH (US)

(72) Inventors: Dana Eagles, Appleton, WI (US); Robert Hansen, North Muskegon, MI (US); Jonas Karlsson, Falkenberg (SE); Manish Jain, Homer, NY (US); Dhruv Agarwal, Cortland, NY (US)

(73) Assignee: Albany International Corp., Rochester, NH (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/865,062

(22) Filed: Sep. 25, 2015

(65) Prior Publication Data

US 2016/0090692 A1 Mar. 31, 2016

Related U.S. Application Data

(60) Provisional application No. 62/055,367, filed on Sep. 25, 2014, provisional application No. 62/222,480, filed on Sep. 23, 2015.

(51) Int. Cl.
*D21F 7/08* (2006.01)
*D21F 1/00* (2006.01)
*D21F 11/00* (2006.01)

(52) U.S. Cl.
CPC ..... *D21F 7/083* (2013.01); *D21F 1/0036* (2013.01); *D21F 11/006* (2013.01)

(58) Field of Classification Search
CPC ..... D21F 7/083; D21F 11/006; D21F 1/0036; D21F 7/08
USPC ..... 162/348
See application file for complete search history.

(56) References Cited

U.S. PATENT DOCUMENTS

| | | | |
|---|---|---|---|
| 1,536,533 | A | 5/1925 | Sheehan |
| 3,323,226 | A | 6/1967 | Beaumont et al. |
| 4,446,187 | A | 5/1984 | Eklund |
| 4,541,895 | A | 9/1985 | Albert |
| 5,360,656 | A | 11/1994 | Rexfelt et al. |
| 5,514,523 | A | 5/1996 | Trokhan et al. |
| 5,609,936 | A | 3/1997 | Kohler et al. |
| 5,776,307 | A | 7/1998 | Ampulski et al. |
| 5,837,102 | A | 11/1998 | Graf |
| 6,071,837 | A | 6/2000 | Crook |
| 6,610,173 | B1 | 8/2003 | Lindsay et al. |
| 6,630,223 | B2 | 10/2003 | Hansen |
| 6,712,940 | B2 | 3/2004 | Crook |
| 6,723,208 | B1 | 4/2004 | Hansen |
| 7,118,647 | B2 | 10/2006 | Cabell et al. |
| 7,166,195 | B2 | 1/2007 | Hawes |
| 7,815,768 | B2 | 10/2010 | Herman |
| 7,815,773 | B2 | 10/2010 | Herman et al. |
| 8,394,239 | B2 | 3/2013 | Eagles et al. |
| 8,454,800 | B2 | 6/2013 | Mourad et al. |
| 8,563,114 | B2 | 10/2013 | Manninen |
| 8,758,569 | B2 | 6/2014 | Aberg et al. |
| 8,764,943 | B2 | 7/2014 | Eagles et al. |
| 2005/0016915 | A1 | 1/2005 | Beck |
| 2005/0167062 | A1 | 8/2005 | Herman et al. |
| 2006/0019567 | A1 | 1/2006 | Sayers |
| 2007/0134467 | A1 | 6/2007 | Sayers |
| 2007/0277951 | A1 | 12/2007 | Westerkamp |
| 2010/0136286 | A1 | 6/2010 | Bez et al. |
| 2010/0186913 | A1 | 7/2010 | Super et al. |
| 2011/0272112 | A1 | 11/2011 | Aberg et al. |
| 2012/0241113 | A1 | 9/2012 | Super et al. |
| 2013/0153167 | A1 | 6/2013 | Eberhardt et al. |
| 2014/0014285 | A1 | 1/2014 | Straub et al. |
| 2016/0090693 | A1* | 3/2016 | Eagles ..... D21F 7/083 162/348 |

FOREIGN PATENT DOCUMENTS

| | | | |
|---|---|---|---|
| CA | 2758622 | A | 5/2013 |
| CA | 2778513 | A | 11/2013 |
| EP | 0 140 404 | A | 5/1985 |
| EP | 1 711 656 | B | 3/2008 |
| WO | WO 86/05219 | A | 9/1986 |
| WO | WO 2004/038093 | A | 5/2004 |
| WO | WO 2010/030298 | A | 3/2010 |
| WO | WO 2011/069259 | A | 6/2011 |
| WO | WO 2012/028601 | A | 3/2012 |
| WO | WO 2012/055690 | A | 5/2012 |
| WO | WO 2012/095251 | A | 7/2012 |
| WO | WO 2013/023272 | A | 2/2013 |

(Continued)

OTHER PUBLICATIONS

"Texin 950", Bayer Material Science, publisher: Global Innovations—Polycarbonates, Edition: Feb. 24, 2009, two pages.

(Continued)

*Primary Examiner* — Mark Halpern
(74) *Attorney, Agent, or Firm* — McCarter & English, LLP

(57) ABSTRACT

A multilayer belt structure that can be used for creping or structuring a cellulosic web in a tissue making process. The multilayer belt structure allows for the formation of various shaped and sized openings in the top surface of the belt, while still providing a structure having the strength, durability, and flexibility required for tissue making processes.

51 Claims, 8 Drawing Sheets

(56) References Cited

FOREIGN PATENT DOCUMENTS

| | | | |
|---|---|---|---|
| WO | WO 2013/071419 | A | 5/2013 |
| WO | WO 2013/177670 | A | 12/2013 |

OTHER PUBLICATIONS

International Search Report and Written Opinion issued by European Patent Office, acting as the International Searching Authority, for International Application PCT/US2015/052128, dated Dec. 3, 2015.

* cited by examiner

MULTILAYER BELT FOR CREPING AND STRUCTURING IN A TISSUE MAKING PROCESS

CROSS-REFERENCE TO RELATED APPLICATION

This application claims the benefit of priority of U.S. Provisional Application Ser. Nos. 62/055,367, filed Sep. 25, 2014 and 62/222,480, filed Sep. 23, 2015. The foregoing applications are incorporated herein by reference in their entirety.

INCORPORATION BY REFERENCE

All patents, patent applications, documents, references, manufacturer's instructions, descriptions, product specifications, and product sheets for any products mentioned herein are incorporated by reference herein.

TECHNOLOGICAL FIELD

Endless fabrics and belts, and particularly, industrial fabrics used as belts in the production of tissue products. As used "herein", tissue also means facial tissue, bath tissue and towels

BACKGROUND

Processes for making tissue products, such as tissue and towel, are well known. Soft, absorbent disposable tissue products, such as facial tissue, bath tissue and tissue toweling, are a pervasive feature of contemporary life in modern industrialized societies. While there are numerous methods for manufacturing such products, in general terms, their manufacture begins with the formation of a cellulosic fibrous web in the forming section of a tissue making machine. The cellulosic fibrous web is formed by depositing fibrous slurry, that is, an aqueous dispersion of cellulosic fibers, onto a moving forming fabric in the forming section of a tissue making machine. A large amount of water is drained from the slurry through the forming fabric, leaving the cellulosic fibrous web on the surface of the forming fabric. Further processing and drying of the cellulosic fibrous web generally proceeds using at least one of two well-known methods.

These methods are commonly referred to as wet-pressing and drying. In wet pressing, the newly formed cellulosic fibrous web is transferred to a press fabric and proceeds from the forming section to a press section that includes at least one press nip. The cellulosic fibrous web passes through the press nip(s) supported by the press fabric, or, as is often the case, between two such press fabrics. In the press nip(s), the cellulosic fibrous web is subjected to compressive forces which squeeze water therefrom. The water is accepted by the press fabric or fabrics and, ideally, does not return to the fibrous web or tissue.

After pressing, the tissue is transferred, by way of, for example, a press fabric, to a rotating Yankee dryer cylinder that is heated, thereby causing the tissue to substantially dry on the cylinder surface. The moisture within the web as it is laid on the Yankee dryer cylinder surface causes the web to adhere to the surface, and, in the production of tissue and towel type products, the web is typically creped from the dryer surface with a creping blade. The creped web can be further processed by, for example, passing through a calender and wound up prior to further converting operations. The action of the creping blade on the tissue is known to cause a portion of the interfiber bonds within the tissue to be broken up by the mechanical smashing action of the blade against the web as it is being driven into the blade. However, fairly strong interfiber bonds are formed between the cellulosic fibers during the drying of the moisture from the web. The strength of these bonds is such that, even after conventional creping, the web retains a perceived feeling of hardness, a fairly high density, and low bulk and water absorbency. In order to reduce the strength of the interfiber bonds that are formed by the wet-pressing method, Through Air Drying ("TAD") can be used. In the TAD process, the newly formed cellulosic fibrous web is transferred to a TAD fabric by means of an air flow, brought about by vacuum or suction, which deflects the web and forces it to conform, at least in part, to the topography of the TAD fabric. Downstream from the transfer point, the web, carried on the TAD fabric, passes through and around the Through-Air-Dryer, where a flow of heated air, directed against the web and through the TAD fabric, dries the web to a desired degree. Finally, downstream from the Through-Air-Dryer, the web may be transferred to the surface of a Yankee dryer for further and complete drying. The fully dried web is then removed from the surface of the Yankee dryer with a doctor blade, which foreshortens or crepes the web thereby further increasing its bulk. The foreshortened web is then wound onto rolls for subsequent processing, including packaging into a form suitable for shipment to and purchase by consumers.

As noted above, there are multiple methods for manufacturing bulk tissue products, and the foregoing description should be understood to be an outline of the general steps shared by some of the methods. Further, there are processes that are alternatives to the Through-Air-Drying process that attempt to achieve "TAD-like" tissue or towel product properties without the TAD units and high energy costs associated with the TAD process.

The properties of bulk, absorbency, strength, softness, and aesthetic appearance are important for many products when used for their intended purpose, particularly when the fibrous cellulosic products are facial or toilet tissue or towels. To produce a tissue product having these characteristics on a tissue making machine, a woven fabric will be used that is often constructed such that the sheet contact surface exhibits topographical variations. These topographical variations are often measured as plane differences between woven yarn strands in the surface of the fabric. For example, a plane difference is typically measured as the difference in height between a raised weft or warp yarn strand or as the difference in height between machine-direction (MD) knuckles and cross-machine direction (CD) knuckles in the plane of the fabric's surface In some tissue making processes as mentioned above, an aqueous nascent web is initially formed in the forming section from a cellulose content furnish, using one or more forming fabrics. Transferring the formed and partly dewatered web to the press section, comprising one or more press nips and one or more press fabrics, the web is further dewatered by an applied compressive force in the nip. In some tissue making machines, after this press dewatering stage, a shape or three dimensional texture is imparted to the web, with the web thereby being referred to as a structured sheet. One manner of imparting a shape to the web involves the use of a creping operation while the web is still in a semi-solid, moldable state. A creping operation uses a creping structure such as a belt or a structuring fabric, and the creping operation occurs under pressure in a creping nip, with the web being forced into openings in the creping structure in the nip. Subsequent to the creping operation, a vacuum may also be used to further draw the web into the openings in the creping structure. After the shaping operation(s) are complete, the web is dried to substantially remove any desired remaining water using well-known equipment, for example, a Yankee dryer.

There are different configurations of structuring fabrics and belts known in the art. Specific examples of belts and structuring fabrics that can be used for creping in a tissue making process can be seen in U.S. Pat. No. 7,815,768 and U.S. Pat. No. 8,454,800 which are incorporated herein by reference in their entirety.

Structuring fabrics or belts have many properties that make them conducive for use in a creping operation. In particular, woven structuring fabrics made from polymeric materials, such as polyethylene terephthalate (PET), are strong, dimensionally stable, and have a three dimensional texture due to the weave pattern and the spaces and are flexible owing to the fact that MD and CD yarns can move slightly over each other, allowing the woven fabric to conform to any irregularities in distance in the fabric run. Fabrics, therefore, can provide both a strong and flexible creping structure that can withstand the stresses and forces during use on the tissue making machine The openings in the structuring fabric, into which the web is drawn during shaping, can be formed as spaces between the woven yarns. More specifically, the openings can be formed in a three dimensional manner as there are "knuckles" or crossovers of the woven yarns in a specific desired pattern in both the machine direction (MD) and cross machine direction (CD). As such, there is an inherently limited variety of openings that can be constructed for a structuring fabric. Further, the very nature of a fabric being a woven structure made up of yarns effectively limits the maximum size and possible shapes of the openings that can be formed. Thus, while woven structuring fabrics are structurally well suited for creping in tissue making processes in terms of strength, durability and flexibility, there are limitations on the types of shaping to the tissue making web that can be achieved when using woven structuring fabrics. As a result, there are limits to simultaneously achieving higher caliper and higher softness of a tissue or towel product made using a woven fabric for the creping operation.

As an alternative to a woven structuring fabric, an extruded polymeric belt structure can be used as the web-shaping surface in a creping operation. Openings (or holes or voids) of different sizes and different shapes can be formed in these extruded polymeric structures, for example, by laser drilling, mechanical punching, embossing, molding, or any other means suitable for the purpose.

The removal of material from the extruded polymeric belt structure in forming the openings, however, has the effect of reducing the strength and resistance to both MD stretch and creep, as well as durability of the belt. Thus, there is a practical limit on the size and/or density of the openings that may be formed in an extruded polymeric belt while still having the belt be viable for a tissue making creping process.

One requirement of a creping belt or fabric is to be configured to substantially prevent cellulose fibers in the web of the tissue or towel product from passing through the openings of the creping belt in the creping nip. As a result, sheet properties such as caliper, strength and appearance will be less than optimum.

SUMMARY

According to various embodiments, described is a multilayer belt for creping and structuring a web in a tissue making process. The belt may also be used in other tissue making processes such as "Through Air Drying" (TAD), Energy Efficient Technologically Advanced Drying ("eTAD"), Advanced Tissue Molding Systems ("ATMOS"), and New Tissue Technology ("NTT").

The belt includes a first layer formed from an extruded polymeric material, with the first layer providing a first surface of the belt on which a partially dewatered nascent tissue web is deposited. The first layer has a plurality of openings extending therethrough, with the plurality of openings having an average cross-sectional area on the plane of the first, or sheet contact, surface, of at least about 0.1 $mm^2$. The belt also includes at least a second layer attached to the first layer, with the second layer forming a second surface of the belt. The second layer has a plurality of openings extending therethrough, with the plurality of openings of the second layer having a smaller cross-sectional area adjacent to an interface between the first layer and the second layer, than the cross-sectional area of the plurality of openings of the first layer adjacent to the interface between the first layer and the second layer.

Also, an alternative embodiment, the diameter of the openings in the first layer can be, at the interface between the two layers, the same or smaller diameter than the openings of the second layer.

According to another embodiment, described is a multilayer belt for structuring a tissue web via either a TAD, eTAD, ATMOS, or NTT process, or creping and structuring a web in a tissue making creping process. The belt includes a first layer formed from an extruded polymeric material, with the first layer providing a first surface of the belt. The first layer has a plurality of openings extending therethrough, with the plurality having a volume of at least about 0.5 $mm^3$. A second layer is attached to the first layer at an interface, with the second layer providing a second surface of the belt, and with the second layer being formed from a woven fabric having a permeability of at least about 200 CFM.

According to a further embodiment, a multilayer belt is provided for creping and/or structuring a web in a tissue making process. The belt includes a first layer formed from an extruded polymeric material, with the first layer providing a first surface of the belt. The first layer has a plurality of openings extending therethrough, with the first surface (i) providing about 10% to about 65% contact area and (ii) having an opening density of about 10/$cm^2$ to about 80/$cm^2$. A second layer is attached to the first layer, with the second layer forming a second surface of the belt, and with the second layer having a plurality of openings extending therethrough. The plurality of openings of the second layer have a smaller cross-sectional area adjacent to an interface between the first layer and the second layer than the cross-sectional area of the plurality of openings at the surface of the first layer adjacent to the interface between the first layer and the second layer. In some embodiments, the size of the openings in the second layer is the same as the size of the openings in the first layer. In other embodiments, the size of the openings in the second layer is larger than the size of the openings in the first layer. In certain embodiments, the ratio of the openings between the first and second layers is 1. In other embodiments, the ratio is greater than 1. In yet other embodiments, the ratio is less than 1.

DETAILED DESCRIPTION OF EMBODIMENTS

Described herein are embodiments of a belt that can be used in tissue making processes. In particular, the belt can be used to impart a texture or structure to a tissue or towel web, either in, for example, a TAD, eTAD, ATMOS, or NTT process or belt creping process, with the belt having a multilayer construction.

The term "Tissue or towel" as used herein encompasses any tissue or towel product having cellulose as a major constituent. This would include, for example, products marketed as paper towels, toilet paper, facial tissues, etc. Furnishes used to produce these products can include virgin pulps or recycle (secondary) cellulosic fibers, or fiber mixes comprising cellulosic fibers. Wood fibers include, for example, those obtained from deciduous and coniferous trees, including softwood fibers, such as northern and southern softwood kraft fibers, and hardwood fibers, such as eucalyptus, maple, birch, aspen, or the like. "Furnishes" and like terminology refers to aqueous compositions including cellulose fibers, and, optionally, wet strength resins, debonders, and the like, for making tissue products.

As used herein, the initial fiber and liquid mixture that is formed, dewatered, textured (structured), creped and dried to a finished product in a tissue making process will be referred to as a "web" and/or a "nascent web."

The terms "machine-direction" (MD) and "cross machine-direction" (CD) are used in accordance with their well-understood meaning in the art. That is, the MD of a belt or creping structure refers to the direction that the belt or creping structure moves in a tissue making process, while CD refers to a direction perpendicular to the MD of the belt or creping structure. Similarly, when referencing tissue products, the MD of the tissue product refers to the direction on the product that the product moved in the tissue making process, and the CD refers to the direction on the tissue product perpendicular to the MD of the product.

"Openings" as referred to herein includes openings, holes or voids, which can be of different sizes and different shapes and which can be formed in the extruded polymeric structures of the belt, for example, by laser drilling, mechanical punching, embossing, molding, or any other means suitable for the purpose.

Tissue Making Machines

Processes utilizing the belt embodiments herein and making the tissue products may involve compactly dewatering tissue making furnishes having a random distribution of fibers so as to form a semi-solid web, and then belt creping the web so as to redistribute the fibers and shape (texture) the web in order to achieve tissue products with desired properties. These steps of the processes can be conducted on tissue making machines having different configurations. Two non-limiting examples of such tissue making machines follow.

Figure 1:
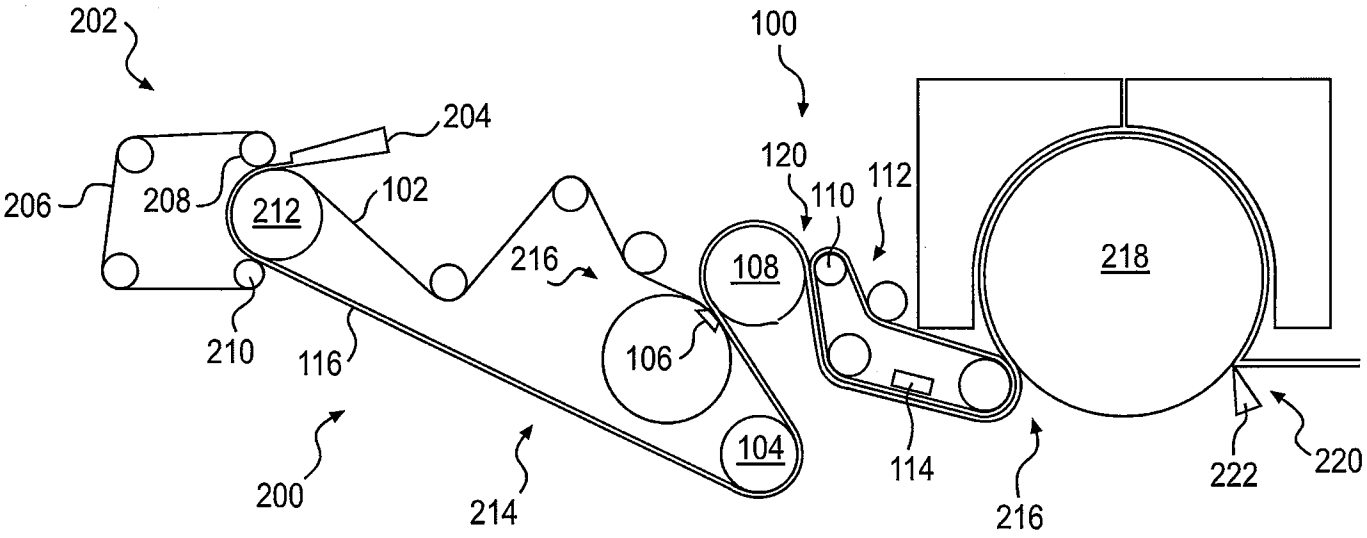
FIG. 1 is a schematic view of a tissue or towel making machine configuration having a creping belt.

FIG. 1 shows a first example of a tissue making machine 200. The machine 200 is a three-fabric loop machine that includes a press section 100 in which a creping operation is conducted. Upstream of the press section 100 is a forming section 202, which, in the case of machine 200, is referred to in the art as a Crescent Former. The forming section 202 includes a headbox 204 that deposits a furnish on a forming fabric 206 supported by rolls 208 and 210, thereby initially forming the tissue web. The forming section 202 also includes a forming roll 212 that supports a press fabric 102 such that web 116 is also formed directly on the press fabric 102. The press fabric run 214 extends to a shoe press section 216 wherein the moist web is deposited on a backing roll 108, with the web 116 being wet-pressed concurrently with the transfer to the backing roll 108.

An example of an alternative to the configuration of tissue making machine 200 includes a twin-fabric forming section, instead of the Crescent Forming section 202. In such a configuration, downstream of the twin-fabric forming section, the rest of the components of such a tissue making machine may be configured and arranged in a similar manner to that of tissue making machine 200. An example of a tissue making machine with a twin-fabric forming section can be seen in U.S. Patent Application Pub. No. 2010/0186913. Still further examples of alternative forming sections that can be used in a tissue making machine include a C-wrap twin fabric former, an S-wrap twin fabric former, or a suction breast roll former. Those skilled in the art will recognize how these, or even still further alternative forming sections, can be integrated into a tissue making machine.

The web 116 is transferred onto the creping belt 112 in a belt creping nip 120, and then vacuum is drawn by vacuum box 114, as will be described in more detail below. After this creping operation, the web 116 is deposited on Yankee dryer 218 in another press nip 216, while a creping adhesive may be spray applied to the Yankee surface. The transfer to the Yankee dryer 218 may occur, for example, with about 4% to about 40% pressurized contact area between the web 116 and the Yankee surface at a pressure of about 250 pounds per linear inch (PLI) to about 350 PLI (about 43.8 kN/meter to about 61.3 kN/meter). The transfer at nip 216 may occur at a web consistency, for example, from about 25% to about 70%. Note that "consistency," as used herein, refers to the percentage of solids of a nascent web, for example, calculated on a bone dry basis. At some consistencies, it is sometimes difficult to adhere the web 116 to the surface of the Yankee dryer 218 firmly enough so as to thoroughly remove the web from the creping belt 112. In order to increase the adhesion between the web 116 and the surface of the Yankee dryer 218, an adhesive may be applied to the surface of the Yankee dryer 218. The adhesive can allow for high velocity operation of the system and high jet velocity impingement air drying, and also allow for subsequent peeling of the web 116 from the Yankee dryer 218. An example of such an adhesive is a poly(vinyl alcohol)/polyamide adhesive composition. Those skilled in the art, however, will recognize the wide variety of alternative adhesives, and further, quantities of adhesives, that may be used to facilitate the transfer of the web 116 to the Yankee dryer 218.

The web 116 is dried on Yankee dryer 218, which is a heated cylinder and by high jet velocity impingement air in the Yankee hood around the Yankee dryer 218. As the Yankee dryer 218 rotates, the web 116 is peeled from the dryer 218 at position 220. The web 116 may then be subsequently wound on a take-up reel (not shown). The reel may be operated faster than the Yankee dryer 218 at steady-state in order to impart a further crepe to the web 116. Optionally, a creping doctor blade 222 may be used to conventionally dry-crepe the web 116. In any event, a cleaning doctor may be mounted for intermittent engagement and used to control buildup of material on the Yankee surface.

Figure 2:
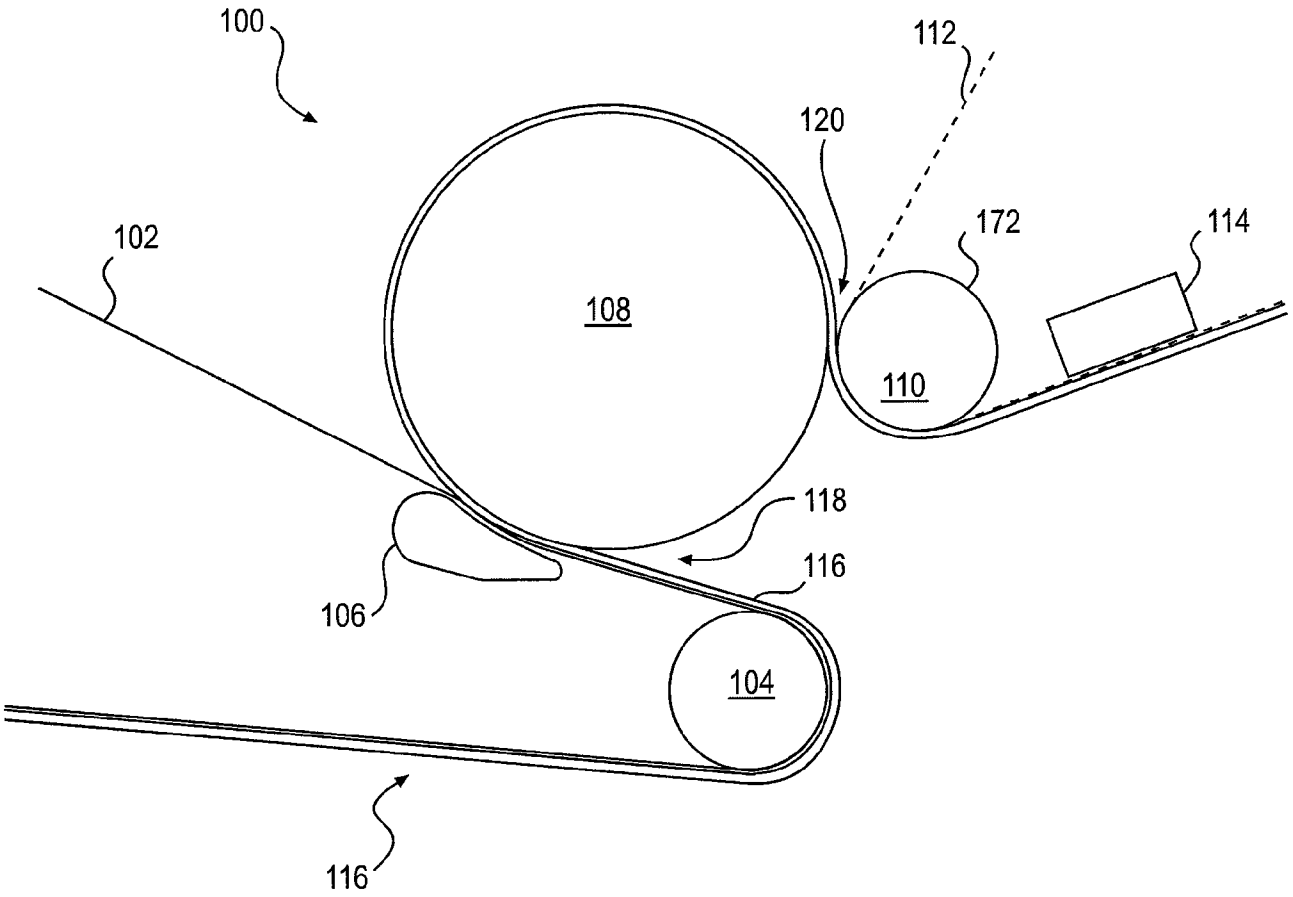
FIG. 2 is a schematic view illustrating the wet-press transfer and belt creping section of the tissue making machine shown in FIG. 1.

FIG. 2 shows details of the press section 100 where creping occurs. The press section 100 includes a press fabric 102, a suction roll 104, a press shoe 106, and a backing roll 108. The press shoe is actually mounted within a cylinder, and said cylinder has a belt mounted upon its circumference, thus looking like roll 106 in FIG. 1. The backing roll 108 may optionally be heated, for example, by steam. The press section 100 also includes a creping roll 110, the creping belt 112, and the vacuum box 114. The creping belt 112 may be configured as a multilayer belt as described below.

In a creping nip 120, the web 116 is transferred onto the top side of the creping belt 112. The creping nip 120 is defined between the backing roll 108 and the creping belt 112, with the creping belt 112 being pressed against the backing roll 108 by the creping roll 110. In this transfer at the creping nip 120, the cellulosic fibers of the web 116 are repositioned and oriented. After the web 116 is transferred onto the belt 112, a vacuum box 114 may be used to apply suction to the web 116 in order to at least partially draw out minute folds. The applied suction may also aid in drawing the web 116 into openings in the creping belt 112, thereby further shaping the web 116. Further details of this shaping of the web 116 are described below.

The creping nip 120 generally extends over a belt creping nip distance or width of anywhere from, for example, about ⅛ in. to about 2 in. (about 3.18 mm to about 50.8 mm), more specifically, about 0.5 in. to about 2 in. (about 12.7 mm to about 50.8 mm). (Even though "width" is the commonly used term, the distance of the nip is measured in the MD). The nip pressure in the creping nip 120 arises from the loading between creping roll 110 and backing roll 108. The creping pressure is, generally, from about 20 to about 100 PLI (about 3.5 kN/meter to about 17.5 kN/meter), more specifically, about 40 PLI to about 70 PLI (about 7 kN/meter to about 12.25 kN/meter). While a minimum pressure in the creping nip may be 10 PLI (1.75 kN/meter) or 20 PLI (3.5 kN/meter), one of skill in the art will appreciate that, in a commercial machine, the maximum pressure may be as high as possible, limited only by the particular machinery employed. Thus, pressures in excess of 100 PLI (17.5 kN/meter), 500 PLI (87.5 kN/meter), or 1000 PLI (175 kN/meter) or more may be used.

In some embodiments, it may by desirable to restructure the interfiber characteristics of the web 116, while, in other cases, it may be desired to influence properties only in the plane of the web 116. The creping nip parameters can influence the distribution of fibers in the web 116 in a variety of directions, including inducing changes in the z-direction (i.e., the bulk of the web 116), as well as in the MD and CD. In any case, the transfer from the creping belt 112 is at high impact in that the creping belt 112 is traveling slower than the web 116 is traveling off of the backing roll 108, and a significant velocity change occurs. In this regard, the degree of creping is often referred to as the creping ratio, with the ratio being calculated as:

$$\text{Creping Ratio } (\%)=(S_1/S_2-1)100$$

where $S_1$ is the speed of the backing roll 108 and $S_2$ is the speed of the creping belt 112. Typically, the web 116 is creped at a ratio of about 5% to about 60%. In fact, high degrees of crepe can be employed, approaching or even exceeding 100%.

Figure 3:
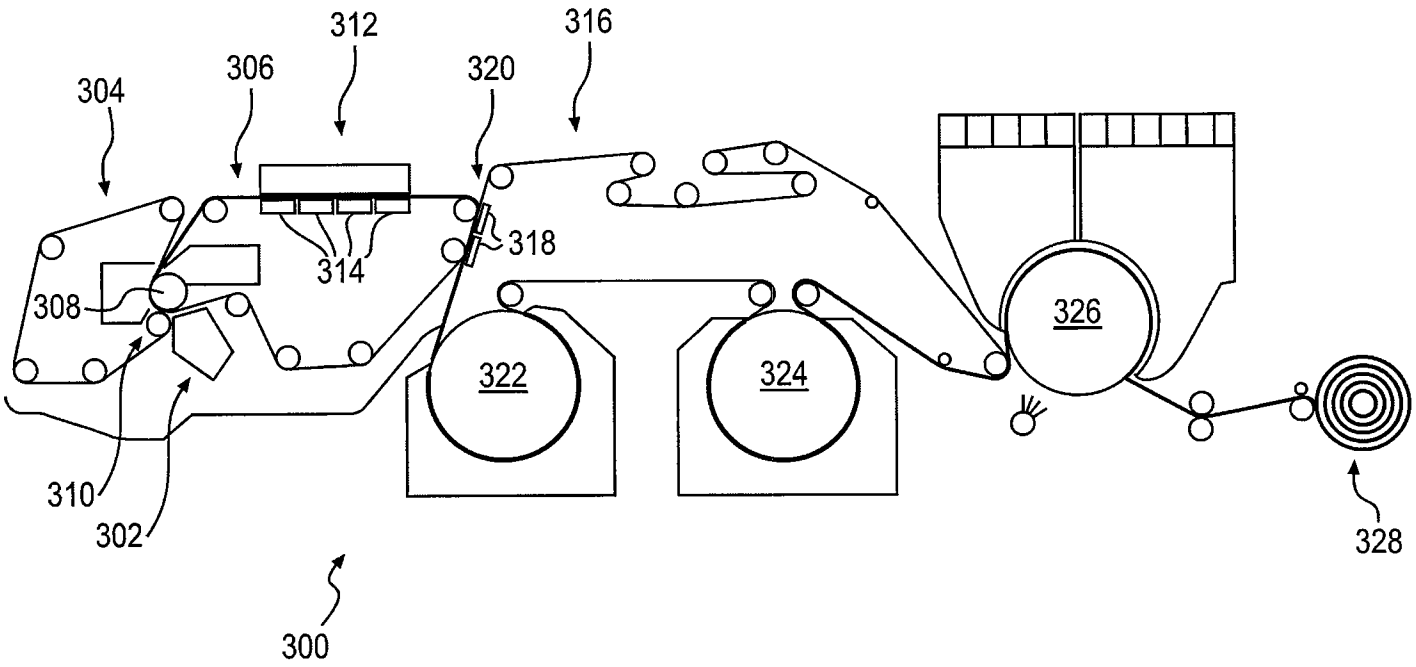
FIG. 3 is a schematic diagram of an alternative tissue making machine configuration having two TAD units.

FIG. 3 depicts a second example of a tissue making machine 300, which can be used as an alternative to the tissue making machine 200 described above. The machine 300 is configured for Through-Air Drying (TAD), wherein water is substantially removed from the web 116 by moving high temperature air though the web 116. As shown in FIG. 3, the furnish is initially supplied in the machine 300 through a headbox 302. The furnish is directed in a jet into a nip formed between a forming fabric 304 and a transfer fabric 306, as they pass between a forming roll 308 and a breast roll 310. The forming fabric 304 and the transfer fabric 306 translate in continuous loops and diverge after passing between the forming roll 308 and the breast roll 310. After separating from the forming fabric 304, the transfer fabric 306 and web 116 pass through a dewatering zone 312 in which suction boxes 314 remove moisture from the web 116 and transfer fabric 306, thereby increasing the consistency of the web 116 from, for example, about 10% to about 25%. The web 116 is then transferred to a Through-Air-Drying surface 316, which can be the multilayer belt described herein. In some embodiments, a vacuum is applied to assist in the transfer of the web 116 to the belt 316, as indicated by the vacuum assist boxes 318 in the transfer zone 320.

The belt 316 carrying the web 116 next passes around Through-Air Dryers 322 and 324, with the consistency of the web 116 thereby being increased, for example, to about 60% to 90%. After passing through the dryers 322 and 324, the web 116 is, more or less, permanently imparted with a final shape or texture. The web 116 is then transferred to the Yankee dryer 326 without a major degradation of properties of the web 116. As described above, in conjunction with tissue making machine 200, an adhesive can be sprayed onto Yankee dryer 326 just prior to contact with the translating web to facilitate the transfer. After the web 116 reaches a consistency of about 96% or greater, a further creping blade is used as may be needed to dislodge the web 116 from the Yankee dryer 326; and then the web 116 is taken up by a reel 328. The reel speed can be controlled relative to the speed of Yankee dryer 326 to adjust the crepe further that is applied to the web 116 as it is removed from the Yankee dryer 326.

It should once again be noted that the tissue making machines depicted in FIGS. 1 and 3 are merely examples of the possible configurations that can be used with the belt embodiments described herein. Further examples include those described in the aforementioned U.S. Patent Application Pub. No. 2010/0186913.

Multilayer Creping Belts

Described herein are embodiments of a multilayer belt that can be used for the creping or drying operations in tissue making machines such as those described above. As will be evident from the disclosure herein, the structure of the multilayer belt provides many advantageous characteristics that are particularly suited for creping operations. It should be noted, however, that inasmuch as the belt is structurally described herein, the belt structure could be used for applications other than creping operations, such as TAD, NTT, ATMOS, or any molding process that provides shape or texture to a tissue web.

A creping belt has diverse properties in order to perform satisfactorily in tissue making machines, such as those described above. On one hand, the creping belt withstands the stresses, applied tension, compression, and potential abrasion from stationary elements that are applied to the creping belt during operation. As such, the creping belt is strong, i.e., includes a high elastic modulus (for dimensional stability), especially in the MD. On the other hand, the creping belt is also flexible and durable in order to run smoothly (flat) at a high speed for extended periods of time. If the creping belt is made too brittle, it will be susceptible to cracking or other fracturing during operation. The combination of being strong, yet flexible, restricts the potential materials that can be used to form a creping belt. That is, the creping belt structure has the ability to achieve the combination of strength, stability in both MD and CD, durability and flexibility.

In addition to being both strong and flexible, a creping belt should ideally allow for the formation of various opening sizes and shapes in the tissue contact layer of the belt. The openings in the creping belt form the caliper-producing domes in the final tissue structure, as described below. Openings in the creping belt also can be used to impart specific shapes, textures and patterns in the web being creped, and thus, the tissue products that are formed. By using different sizes, densities, distribution, and depth of the openings of the top layer of the belt can be used to produce tissue products having different visual patterns, bulk, and other physical properties. As such, potential materials or combination of materials for use in forming a creping belt surface layer includes the ability to form various openings in the desired shapes, densities and patterns in the surface layer material of the multilayer belt to be used for supporting and texturing the web during the creping operation.

Extruded polymeric materials can be formed into creping belts having various openings, and hence, extruded polymeric materials are possible materials for use in forming a creping belt. In particular, precisely shaped openings can be formed in an extruded polymeric belt structure by different techniques, including, for example, laser drilling or cutting, embossing, and/or mechanical punching Embodiments of the creping belt as described herein provide desirable aspects of a multilayer creping belt by providing different properties to the belt in different layers of the overall multilayer belt structure. In embodiments, the multilayer belt includes a top layer made from an extruded polymeric material that allows for openings with various shapes, sizes, patterns and densities to be formed in the layer. The bottom layer of the multilayer belt is formed from a structure that provides strength, dimensional stability and durability to the belt. By providing these characteristics in the bottom layer, the top extruded polymeric layer can be provided with larger openings than could otherwise be provided in a belt comprising only an extruded monolithic polymeric layer because the top layer of the multilayer belt need not contribute much, if any at all, to the strength, stability and durability of the belt.

According to embodiments, a multilayer creping belt comprises at least two layers. As used herein, a "layer" is a continuous, distinct part of the belt structure that is physically separated from another continuous, distinct layer in the belt structure. As discussed below, an example of two layers in a multilayer belt are an extruded polymeric layer that is bonded with an adhesive to the woven fabric layer. Notably, a layer, as defined herein, could include a structure having another structure substantially embedded therein. For example, U.S. Pat. No. 7,118,647 describes a paper making belt structure wherein a layer that is made from photosensitive resin has a reinforcing element embedded in the resin. This photosensitive resin with a reinforcing element is a layer. At the same time, however, the photosensitive resin with the reinforcing element does not constitute a "multilayer" structure as used herein, as the photosensitive resin with the reinforcing element are not two continuous, distinct parts of the belt structure that are physically distinct or separated from each other.

Details of the top and bottom layers for a multilayer belt according to embodiments are described next. Herein, the "top" or "sheet contact" side of the multilayer creping belt refers to the side of the belt on which the web is deposited. Hence, the "top layer" is the portion of the multilayer-belt that forms the surface onto which the cellulosic web is shaped in the creping operation. The "bottom" or "machine" side of the creping belt, as used herein, refers to the opposite side of the belt, i.e., the side that faces and contacts the processing equipment such as the creping roll and the vacuum box. And, accordingly, the "bottom layer" provides the bottom side surface.

Top Layer

One of the functions of the extruded polymeric top layer of a multilayer belt according to embodiments is to provide a structure into which openings can be formed, with the openings passing through the layer from one side of the layer to the other, and with the openings imparting dome shapes to the web during a step in a tissue making process. In embodiments, the top layer may not need to impart any strength, stability, stretch or creep resistance, or durability to the multilayer creping belt per se, as these properties can be provided primarily by the bottom layer, as described below. Further, the openings in the top layer may not be configured to prevent cellulose fibers from the web from being pulled essentially all the way through the top layer in the tissue making process, as this "prevention" can also be achieved by the bottom layer, as described below.

In embodiments, the top layer of the multilayer belt is made from an extruded flexible thermoplastic material. In this regard, there is no particular limitation on the types of thermoplastic materials that can be used to form the top layer, as long as the material generally has the properties such as friction (between the paper sheet and belt), compressibility, flex fatigue and crack resistance, and ability to temporarily adhere and release the web from its surface when required. And, as will be apparent to those skilled in the art from the disclosure herein, there are numerous possible flexible thermoplastic materials that can be used that will provide substantially similar properties to the thermoplastics specifically discussed herein. It should also be noted that the term "thermoplastic material" as used herein is intended to include thermoplastic elastomers, e.g., "rubber like" materials. It should be further noted that thermoplastic material could incorporate other thermoplastic materials in fiber form (e.g., chopped polyester fiber) or non-thermoplastic materials, such as those found in composite materials, as additives to the extruded layer to enhance some desired property.

A thermoplastic top layer can be made by any suitable technique, for example, by molding or extruding. For example, the thermoplastic top layer (or any additional layers) can be made from a plurality of sections that are abutted and joined together side to side in a spiral fashion.

Such a technique to form that layer from extruded strips of material can be that as taught in U.S. Pat. No. 5,360,656 to Rexfelt et al., the entire contents of which are incorporated herein by reference. Also the extruded layer can be made from the extruded strips and abutted and joined side by side as taught in U.S. Pat. No. 6,723,208 B1, the entire contents of which are incorporated herein by reference. Or, for that matter, the layer can be formed from the extruded strips by the method as taught in U.S. Pat. No. 8,764,943.

The abutting edges may be skived at an angle or formed in other manners such as shown in U.S. Pat. No. 6,630,223 to Hansen, the disclosure of which is incorporated herein by reference.

Other techniques to form this layer are known in the art. Individual endless loops of the extruded material can be formed and seamed into an endless loop of appropriate length with a CD or diagonal oriented seam by techniques known to those skilled in the art. These endless loops are then brought into a side to side abutting arrangement, the number of loops dictated by the CD with of the loops and the total CD width required for the finished belt. The abutting edges can be created and joined to each other using techniques as known in the art, for example, as taught in U.S. Pat. No. 6,630,223, referenced above.

In specific embodiments, the material used to form the top layer of the multilayer belt is a polyurethane. In general, thermoplastic polyurethanes are manufactured by reacting (1) diisocyanates with short-chain diols (i.e., chain extenders) and (2) diisocyanates with long-chain bifunctional diols (i.e., polyols). The practically unlimited number of possible combinations producible by varying the structure and/or molecular weight of the reaction compounds allows for an enormous variety of polyurethane formulations. And, it follows that polyurethanes are thermoplastic materials that can be made with a very wide range of properties. When considering polyurethanes for use as the extruded top layer in a multilayer creping belt according to embodiments, the hardness of the polyurethane can be adjusted, to reach a compromise of properties such as abrasion resistance, crack resistance, and through thickness compressibility.

Further, it is advantageous to be able to adjust the hardness of the polyurethane, and correspondingly, the coefficient of friction of the surface of the polyurethane. TABLE 1 shows properties of an example of polyurethane that is used to form the top layer of the multilayer belt in some embodiments of the invention.

TABLE 1

| Property | Units | Standard | Value |
|---|---|---|---|
| Flexural Modulus (73° F.) | lb/in$^2$ | ASTM D790 | 16500 |
| Flexural Modulus (158° F.) | lb/in$^2$ | ASTM D790 | 6800 |
| Tensile Strength | lb/in$^2$ | ASTM D412 | 6000 |
| Ultimate Elongation | % | ASTM D412 | 400 |
| Tensile Strength (50% Elongation) | lb/in$^2$ | ASTM D412 | 1750 |
| Tensile Strength (100% Elongation) | lb/in$^2$ | ASTM D412 | 2000 |
| Tensile Strength (300% Elongation) | lb/in$^2$ | ASTM D412 | 4000 |
| Compression Set, as molded (22 hours at 73° F.) | % | ASTM D395-B | 20 |
| Compression Set, as molded (22 hours at 158° F.) | % | ASTM D395-B | 70 |
| Compression Set, post-cured (22 hours at 73° F., post-cured 16 hours at 230° F.) | % | ASTM D395-B | 15 |
| Compression Set, post-cured (22 hours at 158° F., post-cured 16 hours at 230° F.) | % | ASTM D395-B | 40 |
| Compressive load (2% deflection) | lb/in$^2$ | ASTM D575 | 150 |
| Compressive load (5% deflection) | lb/in$^2$ | ASTM D575 | 425 |
| Compressive load (10% deflection) | lb/in$^2$ | ASTM D575 | 800 |
| Compressive load (15% deflection) | lb/in$^2$ | ASTM D575 | 1100 |
| Compressive load (20% deflection) | lb/in$^2$ | ASTM D575 | 1500 |
| Compressive load (25% deflection) | lb/in$^2$ | ASTM D575 | 1800 |
| Compressive load (50% deflection) | lb/in$^2$ | ASTM D575 | 4500 |
| Tear Strength, Die C | lbf/in | ASTM D624 | 750 |
| Glass transition temperature (dynamic mechanical analysis) | ° F. | DMA | −17 |
| Low-temperature brittle point | ° F. | ASTM D746 | <−90 |
| Vicat softening temperature | ° F. | ASTM D1525 | 262 |
| Coefficient of linear thermal expansion, flow/cross-flow | in/in/° F. | ASTM D696 | 7E−5 |
| Specific gravity | | ASTM D792 | 1.15 |
| Shore hardness | D scale | ASTM D2240 | 50 |
| Taber abrasion H-18 wheel; 1000-g; 1000 cycles | mg Loss | ASTM D3489 | 75 |
| Bayshore resilience | % | ASTM D2632 | 35 |
| Mold shrinkage, flow/cross to flow | in/in | ASTM D955 | 0.008 |

The polyurethane shown in Table 1 was used to form the top layer in the Belts 2 to 8 described below. The specific polyurethane properties shown in Table 1, however, are merely exemplary, as any or all of the properties may be varied while still providing a material suitable for the top layer of the multilayer belt described herein. Any suitable polyurethane may be used in embodiments of the instant invention.

As an alternative to polyurethane, an example of a specific polyester thermoplastic that may be used to form the top layer in other embodiments of the invention is sold under the name HYTREL® by E. I. du Pont de Nemours and Company of Wilmington, Del. HYTREL®, in various species, is a polyester thermoplastic elastomer with the crack resistance, compressibility, and tensile properties conducive to forming the top layer of the multilayer creping belt described herein.

Thermoplastics, such as the polyurethanes and polyester described above, are advantageous materials for forming the top layer of the inventive multilayer belt when considering the ability to form openings of different sizes, shapes, densities and configurations in an extruded thermoplastic material. Openings in the extruded thermoplastic top layer may be formed using a variety of techniques. Examples of such techniques include laser engraving, drilling, or cutting or mechanical punching with or without embossing. As will be appreciated by those skilled in the art, such techniques can be used to form large and consistently-sized openings in various patterns, sizes and densities. In fact, openings of most any type (dimensions, shape, sidewall angle, etc.) can be formed in a thermoplastic top layer using such techniques.

When considering the different configurations of the openings that can be formed in the extruded top layer, it will be appreciated that the openings or even patterns or densities, need not be identical over the entire surface. That is, some of the openings formed in the extruded top layer can have different configurations from other openings that are formed in the extruded top layer. In fact, different openings could be provided in the extruded top layer in order to provide different textures to the web in the tissue making process. For example, some of the openings in the extruded top layer could be sized and shaped to provide for forming dome structures in the tissue web during the creping operation. At the same time, other openings in the top layer could be of a much greater size and a varying shape so as to provide patterns in the tissue web that are equivalent to patterns that are achieved with an embossing operation, however without the subsequent loss in sheet bulk and other desired tissue properties.

When considering the size of the openings for forming the dome structures in the tissue web in a belt creping operation, the extruded top layer of the embodiments of the multilayer belt allows for much larger size openings than alternative structures, such as woven structuring fabrics and extruded, monolithic polymeric belt structures. The size of the openings may be quantified in terms of the cross-sectional area of the openings in the plane of the surface of the multilayer belt provided by the top layer. In some embodiments, the openings in the extruded top layer of a multilayer belt have an average cross-sectional area on the sheet contact (top) surface of at least about 0.1 $mm^2$ to at least about 1.0 $mm^2$. More specifically, the openings have an average cross-sectional area from about 0.5 $mm^2$ to about 15 $mm^2$, or still more specifically, about 1.5 $mm^2$ to about 8.0 mm2, or even more specifically, about 2.1 $mm^2$ to about 7.1 $mm^2$.

In an extruded polymeric monolithic belt, for example, openings of these sizes would require the removal of the bulk of the material forming a polymeric monolithic belt such that the belt would likely not be strong enough to withstand the rigors and stresses of a belt creping process. As will also be readily appreciated by those skilled in the art, a woven fabric used as a creping belt, could likely not be provided with the equivalent to these size openings, as the yarns of the fabric could not be woven (spaced apart or sized) to provide such an equivalent to these sizes, and yet still provide enough structural integrity to be able to function in a belt creping or other tissue structuring process.

The size of the openings in the extruded layer may also be quantified in terms of volume. Herein, the volume of an opening refers to the space that the opening occupies through the thickness of the belt surface layer. In embodiments, the openings in the extruded polymeric top layer of a multilayer belt may have a volume of at least about 0.05 $mm^3$. More specifically, the volume of the openings may range from about 0.05 $mm^3$ to about 2.5 $mm^3$, or more specifically, the volume of the openings ranges from about 0.05 $mm^3$ to about 11 $mm^3$. In further embodiments the openings can be at least 0.25 $mm^3$ and increase from there.

Other unique characteristics of the multilayer belt include the percentage of contact area provided by the top surface of the belt. The percent contact area of the top surface refers to the percentage of the surface of the belt that is not an opening. The percent contact layer is related to the fact that larger openings can be formed in the inventive multilayer belt than in woven structuring fabrics or extruded polymeric monolithic belts. That is, openings, in effect, reduce the contact area of the top surface of the belt, and as the multilayer belt can have larger openings, the percent contact area is reduced. In some embodiments, the extruded top surface of the multilayer belt provides from about 10% to about 65% contact area. In more specific embodiments, the top surface provides from about 15% to about 50% contact area, and, in still more specific embodiments, the top surface provides from about 20% to about 33% contact area. As mentioned above, there can be areas in this layer that have a different opening density from the rest of the structure, thus different patterns if desired. Even logos, or other designs, may be present in the pattern.

Opening density is yet another measure of the relative size and number of openings in the top surface provided by the extruded top layer of the multilayer belt. Here, opening density of the extruded top surface refers to the number of openings per unit area, e.g., the number of openings per $cm^2$. In certain embodiments, the top surface provided by the top layer has an opening density of from about 10/$cm^2$ to about 80/$cm^2$. In more specific embodiments, the top surface provided by the top layer has an opening density of from about 20/$cm^2$ to about 60/$cm^2$, and, in still more specific embodiments, the top surface has an opening density of from about 25/$cm^2$ to about 35/$cm^2$. As mentioned above, there can be areas in this layer that have a different opening density from the rest of the structure. As described herein, the openings in the extruded top layer of the multilayer belt form dome structures in the web during a creping operation. Embodiments of the multilayer belt can provide higher opening densities than can be formed in an extruded monolithic belt, and higher opening densities than could equivalently be achieved with a woven fabric. Thus, the multilayer belt can be used to form more dome structures in a web during a creping operation than an extruded polymeric monolithic belt or a woven structuring fabric by itself, and accordingly, the multilayer belt can be used in a tissue making process that produces tissue products having a greater number of dome structures than could woven structuring fabrics or extruded monolithic belts, thus imparting desirable characteristics to the tissue product, such as softness and absorbency.

Another aspect of the creping surface formed by the extruded top layer of the multilayer belt that effect the creping process is the friction and hardness of the top surface. Without being bound by theory, it is believed that a softer creping structure (belt or fabric) will provide better pressure uniformity inside of a creping nip, providing for a more uniform tissue product. Further, the friction on the surface of the creping belt structure minimizes slippage of the web during the transfer of the web to the creping belt structure in the creping nip. Less slippage of the web causes less wear on the creping belt structure, and allows for the creping structure belt to work well for both the upper and lower basis weight ranges. It should also be noted that a creping belt can prevent web slippage without substantially damaging the web. In this regard, the creping belt is advantageous over a woven fabric structure because knuckles on the surface of the woven fabric may act to disrupt the web during the creping operation. Thus, a multilayer belt structure may provide a better result in the low basis weight range where web disruptions can be detrimental in the creping process. This ability to work in a low basis weight range may be advantageous, for example, when forming facial tissue products.

When considering the material for use in extruding the top layer of embodiments of the multilayer belt, polyurethane is a well-suited material, as discussed above. Polyurethane is a relatively soft material for use in a creping belt, especially when compared to materials that could be used to form an extruded polymeric monolithic creping belt. At the same time, polyurethane can provide a relatively-high friction surface. Polyurethane is known to have a coefficient of friction ranging from about 0.5 to about 2 depending on its formulation, and a particular polyurethane described in TABLE 1 above had a coefficient of friction of about 0.6. Notably, one HYTREL® thermoplastic species, also discussed above as being a well-suited material for forming the top layer, has a coefficient of friction of about 0.5. Thus, the inventive multilayer belt can provide a soft and high-friction top surface, effecting a "soft" sheet creping operation.

Accordingly, in embodiments, the top layer can be formed using an extruded thermoplastic elastomer material. Thermoplastic elastomers (TPE) can be selected from, for example, a polyester TPE, a nylon based TPE and a thermoplastic polyurethane (TPU) elastomer. The TPEs and TPUs that can be used to make embodiments of the belts range, after extrusion, from shore hardness grades of about 6OA to about 95A, and from about 30D to about 85D respectively. Both ether and ester grades of TPUs may be used to make belts. These belts can also be made with blends of various grades of either polyester or nylon based TPEs or TPU elastomers based on the end application demand on the final multilayer belt properties. The TPE's and TPU elastomers can also be modified using heat stabilizer additives to control and enhance heat resistance of the belt. Examples of polyester based TPEs include thermoplastics sold under the following names: HYTREL® (DuPont), Arnitei® (DSM), Riteflex® (Ticona), Pibiflex® (Enichem). Examples of nylon based TPE's include Pebax® (Arkema), Vetsamid-E® (Creanova), Grilon®/Grilamid® (EMS-Chemie). Examples of TPU elastomers include Estane®, Pearlthane® (Lubrizol), Ellastolan® (BASF), Desmopan® (Bayer), and Pellethane® (DOW).

The properties of the top surface of the extruded top layer, can be changed through the application of a coating on the top, sheet contact surface. In this regard, a coating can be added to the top surface, for example, to increase or to decrease the friction or sheet release characteristic of the top surface. Additionally, or alternatively, a coating can be permanently added to the top surface of the extruded layer to, for example, improve the abrasion resistance of the top surface. This can be applied before or after the openings are put in the top layer, as long as the belt remains permeable to air and water after the coating is applied. Examples of such coatings include both hydrophobic and hydrophilic compositions, depending on the specific tissue making processes in which the multilayer belt is to be used.

Bottom Layer

The bottom layer of the multilayer creping belt functions to provide strength, resistance to MD stretch and creep, CD stability and durability to the belt.

As with the top layer, the bottom layer also includes a plurality of openings through the thickness of the layer. At least one opening in the bottom layer may be aligned with at least one opening in the extruded top layer, and thus, openings are provided through the thickness of the multilayer belt, i.e., through the top and bottom layers. The openings in the bottom layer, however, are smaller than the openings in the top layer. That is, the openings in the bottom layer have a smaller cross-sectional area adjacent to the interface between the extruded top layer and the bottom layer than the cross-sectional area of the plurality of openings of the top layer adjacent to the interface between the top and bottom layers. The openings in the bottom layer, therefore, can prevent cellulosic fibers from being pulled from the tissue web completely through the multilayer belt structure when the belt/web is exposed to vacuum. As generally discussed above, cellulose fibers that are pulled from the web through the belt are detrimental to the tissue making process in that the fibers build up in the tissue machine over time, e.g., accumulating on the outside rim of the vacuum box. The buildup of fibers necessitates machine down time in order to clean out the fiber buildup. The loss of fibers is also detrimental to retaining good tissue sheet properties such as absorbency and appearance. The openings in the bottom layer, therefore, can be configured to substantially prevent cellulose fibers from being pulled all the way through the belt. However, because the bottom layer does not provide the creping surface, and thus, does not act to shape the web during the creping operation, configuring the openings in the bottom layer to prevent fiber pull through does not substantially affect the creping operation of the belt.

In the embodiments of the multilayer belt, a woven fabric is provided as the bottom layer of the multilayer creping belt. As discussed above, woven structuring fabrics have the strength and durability to withstand the stresses and demands of a belt creping operation for example. And, as such, woven structuring fabrics have been used, by themselves, as fabrics in creping or other tissue structuring processes. However, other woven fabrics of various constructions may also be used as long as they have the required properties. A woven fabric, therefore, can provide the strength, stability, durability and other properties for the multilayer creping belt according to embodiments of the invention.

In specific embodiments of the multilayer creping belt, the woven fabric provided for the bottom layer may have similar characteristics to woven structuring fabrics used by themselves as creping structures. Such fabrics have a woven structure that, in effect, has a plurality of "openings" formed between the yarns making up the fabric structure. In this regard, the result of the openings in a woven fabric may be quantified as an air permeability; that is, a measurement of airflow through the fabric. The permeability of the fabric, in conjunction with the openings in the extruded top layer, allows air to be drawn through the belt. Such airflow can be drawn through the belt by a vacuum box in the tissue making machine, as described above. Another aspect of the woven fabric layer is the ability to prevent cellulose fibers from the web from being pulled completely through the multilayer belt at the vacuum box The permeability of a fabric is measured according to well-known equipment and tests in the art, such as Frazier® Differential Pressure Air Permeability Measuring Instruments by Frazier Precision Instrument Company of Hagerstown, Md. In embodiments of the multilayer belt, the permeability of the fabric bottom layer is at least about 200 CFM. In more specific embodiments, the permeability of the fabric bottom layer is from about 200 CFM to about 1200 CFM, and in even more specific embodiments, the permeability of the fabric bottom layer is between about 300 CFM to about 900 CFM. In still further embodiments, the permeability of the fabric bottom layer is from about 400 CFM to about 600 CFM.

Furthermore, it is understood that all the embodiments of the multilayer belts herein are permeable to both air and water.

TABLE 2 shows specific examples of woven fabrics that can be used to form the bottom layer in the multilayer creping belts. All of the fabrics identified in TABLE 2 are manufactured by Albany International Corp. of Rochester, N.H.

TABLE 2

| Name | Mesh (cm) | Count (cm) | Warp Size (mm) | Shute Size (mm) | Perm. (CFM) |
|---|---|---|---|---|---|
| ElectroTech 55LD | (22) | (19) | 0.25 | 0.4 | 1000 |
| U5076 | 15.5 | 17.5 | 0.35 | 0.35 | 640 |
| J5076 | 33 | 34 | 0.17 | 0.2 | 625 |
| FormTech 55LD | 21 | 19 | 0.25 | 0.35 | 1200 |
| FormTech 598 | 22 | 15 | 0.25 | 0.35 | 706 |
| FormTech 36BG | 15 | 16 | 0.40 | 0.40 | 558 |

Specific examples of multilayer belts with J5076 fabric as the bottom layer are exemplified below. J5076 is woven from polyethylene terephthalate (PET) yarns, and itself has been used as a creping structure in paper making processes.

As an alternative to a woven fabric, in other embodiments of the invention, the bottom layer of the multilayer creping belt can be formed from an extruded thermoplastic material. Unlike the flexible thermoplastic materials used to form the top layer discussed above, the thermoplastic material used to form the bottom layer is provided in order to impart strength, stretch resistance, and durability, etc. to the multilayer creping belt. Examples of thermoplastic materials that can be used to form the bottom layer include polyesters, copolyesters, polyamides, and copolyamides. Specific examples of polyesters, copolyesters, polyamides, and copolyamides that can be used to form the bottom layer can be found in the aforementioned U.S. Patent Application Pub. No. 2010/0186913.

In specific embodiments of the invention, polyethylene terephthalate (PET) may be used to from the extruded bottom layer of the multilayer belt. PET is a well-known durable and flexible polyester. In other embodiments, HYTREL® (which is discussed above) may be used to form the extruded bottom layer of the multilayer belt. Those skilled in the art will recognize similar alternative materials that could be used to form the bottom layer.

When using an extruded polymeric material for the bottom layer, openings may be provided through the polymeric material in the same manner as the openings are provided in the top layer, e.g., by laser drilling, cutting, or mechanical perforation. At least some of the openings in the bottom layer are aligned with the openings in the top layer, thereby allowing for air flow through the multilayer belt structure in the same manner that a woven fabric bottom layer allows for air flow through the multilayer belt structure. The openings in the bottom layer need not be the same size as the openings in the top layer. In fact, in order to reduce fiber pull-through in a manner analogous to a fabric bottom layer, the openings in the extruded polymeric bottom layer may be substantially smaller than the openings in the top layer. In general, the size of the openings in the bottom layer can be adjusted to allow for certain amounts of air flow through the belt. Moreover, multiple openings in the bottom layer may be aligned with an opening in the top layer. A greater air flow can be drawn through the belt at a vacuum box if multiple openings are provided in the bottom layer, so as to provide a greater total opening area in the bottom layer relative to the opening area in the top layer. At the same time, the use of multiple openings with a smaller cross-sectional area reduces the amount of fiber pull-through relative to a single, larger, opening in the bottom layer. In a specific embodiment of the invention, the openings in the second layer have a maximum cross-sectional area of 350 microns adjacent to the interface with the first layer.

Along these lines, in embodiments of the invention with an extruded polymeric top layer and an extruded polymeric bottom layer, a characteristic of the belt is the ratio of the cross-sectional area of the openings at the top surface provided by the top layer to the cross-sectional area of the openings in the bottom surface provided by the bottom layer. In embodiments of the invention, this ratio of cross-sectional areas of the top and bottom openings ranges from about 1 to about 48. In more specific embodiments, the ratio ranges from about 4 to about 8. In an even more specific embodiment, the ratio is about 5.

There are other structures that may be used to form the bottom layer in alternatives to the woven fabric and extruded polymeric layer described above. For example, in an embodiment of the invention, the bottom layer may be formed from metallic structures, and in a particular embodiment, a metallic screen-like structure. The metallic screen provides the strength and flexibility properties to the multilayer belt in the same manner as the woven fabric and extruded polymeric layer described above. Further, the metallic screen functions to prevent cellulose fibers from being pulled through the belt structure, in the same manner as the woven fabric and extruded polymeric layer described above. A still further alternative material that could be used to form the bottom layer is a super-strong, high tenacity, high modulus fiber material, such as a material formed from para-aramid synthetic fibers. Super-strong fibers may differ from the woven fabrics described above by not being woven together, but yet still capable of forming a strong and flexible bottom layer. This can be an array of yarns parallel to each other in the MD, or a nonwoven fibrous layer with fiber orientation preferably in the MD. In addition to aramid fibers, other polymeric materials, such as polyesters, polyamides, etc. can be used, as long as there is adequate tensile strength to stabilize the multilayer belt. Those ordinarily skilled in the art will recognize still further alternative structures that are capable of providing the properties of the bottom layer of the multilayer belt described herein.

Multilayer Structure

The multilayer belt according to embodiments is formed by connecting or laminating the above-described extruded polymeric top and woven fabric bottom layers. As will be understood from the disclosure herein, the connection between the layers can be achieved using a variety of different techniques, some of which will be described more fully below.

Figure 4A:
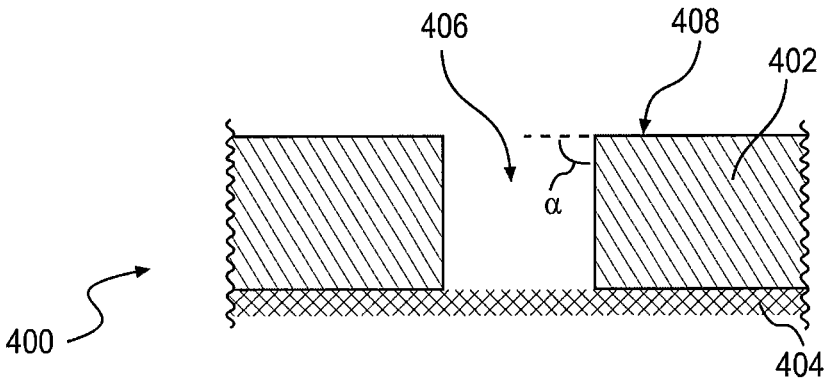
FIG. 4A is a cross-sectional view of a portion of a multilayer creping belt according to one embodiment.

FIG. 4A is a cross-sectional view of a portion of a multilayer creping belt 400 according to an embodiment, not drawn to scale. The belt 400 includes an extruded polymeric top layer 402 and a woven fabric bottom layer 404. The top layer 402 provides the top surface 408 of the belt 400 on which the web is creped and/or structured during the creping operation of the tissue making process. An opening 406 is formed in the top layer 402, as described above. Note that the opening 406 extends through the thickness of the top layer 402 from the top surface 408 to the surface facing the fabric bottom layer 404. As the woven fabric bottom layer 404 is a structure with a certain air permeability, a vacuum can be applied to the woven fabric bottom layer 404 side of the belt 400, and thus, draw an airflow through the opening 406 and the woven fabric 404. During the creping operation using the belt 400, cellulosic fibers from the web are drawn into the opening 406 in the top layer 402, which will result in a dome structure being formed in the web.

Figure 4B:
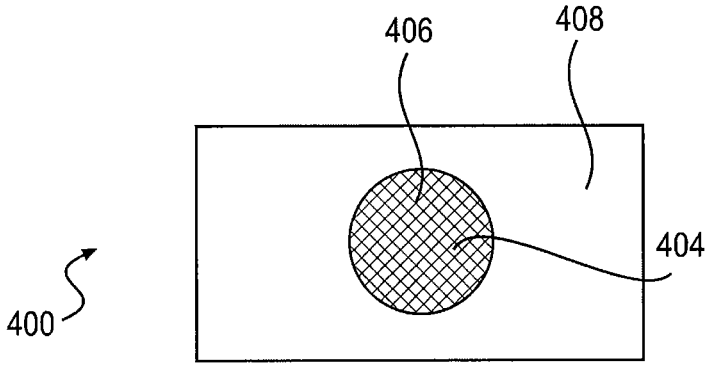
FIG. 4B is a top view of the portion of shown in FIG. 4A.

FIG. 4B is a top view of the belt 400 looking down on the portion with the opening 406 shown in FIG. 4A. As is evident from FIGS. 4A and 4B, while the woven fabric 404 allows the vacuum (and air) to be drawn through the belt 400, the woven fabric 404 also effectively "closes off" the opening 406 in the top layer. That is, the woven fabric second layer 404 in effect provides a plurality of openings that have a smaller cross-sectional area adjacent to the interface between the extruded polymeric top layer 402 and the woven fabric second layer 404. Thus, the woven fabric 404 can substantially prevent cellulosic fibers from the web from passing all the way through the belt 400. As described above, the woven fabric 404 also imparts strength, durability, and stability to the belt 400.

Figure 7A:
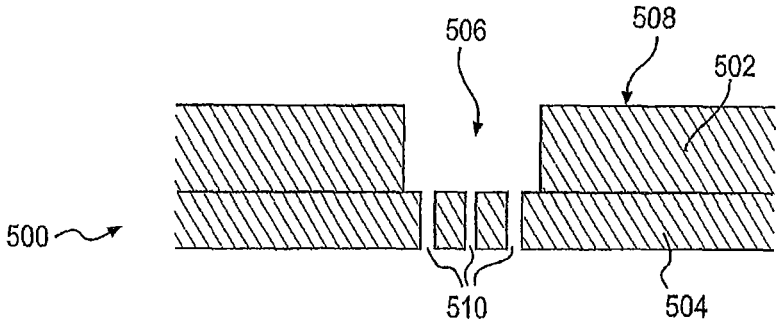
FIG. 7A is a cross-sectional view of a portion of a multilayer creping belt according to another embodiment of the invention.
Figure 7B:
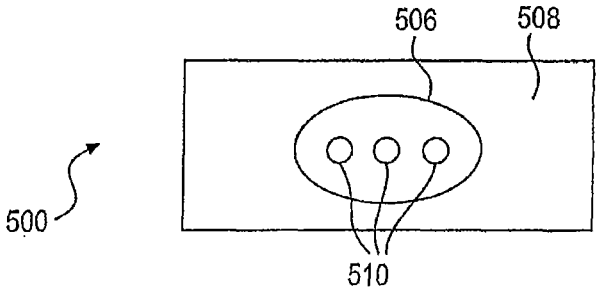
FIG. 7B is a top view of the portion shown in FIG. 7A.

FIG. 7A is a cross-sectional view of a portion of a multilayer creping belt 500 according to an embodiment of the invention that includes an extruded polymeric top layer 502 and an extruded polymeric bottom layer 504. The top layer 502 provides the top surface 508 on which a paper making web is creped. In this embodiment, the opening 506 in the top layer 504 is aligned with three openings 510 in the bottom layer. As is evident from the top-view of the belt portion 500 shown in FIG. 7B, the openings 510 in the bottom layer 504 have a substantially smaller cross section than the opening 506 in the top layer 502. That is, the bottom layer 504 includes a plurality of openings 510 having a smaller cross-sectional area adjacent to the interface between the top layer 502 and the bottom layer 504. This allows the extruded polymeric bottom layer 504 to function to substantially prevent fibers from being pulled through the belt structure, in the same manner as a woven fabric bottom layer described above. It should be noted, that, as indicated above, in alternative embodiments, a single opening in the extruded polymeric bottom layer 504 may be aligned with the opening 506 in the extruded polymeric top layer. In fact, any number of openings may be formed in the bottom layer 504 for each opening in the top layer 508.

The openings 406, 506, and 510 in the extruded polymeric layers in the belts 400 and 500 are such that the walls of the openings 406, 506, and 510 extend orthogonal to the surfaces of the belts 400 and 500. In other embodiments, however, the walls of the openings 406, 506, and 510 may be provided at different angles relative to the surfaces of the belts. The angle of the openings 406, 506, and 510 can be selected and made when the openings are formed by techniques such as laser drilling, cutting or mechanical perforation and/or embossing. In specific examples, the sidewalls have angles from about 60° to about 90°, and more specifically, from about 75° to about 85°. In alternative configurations, however, the sidewall angle may be greater than about 90°. Note, the sidewall angle referred to herein is measured as indicated by the angle $\alpha$ in FIG. 4A.

In any of the embodiments described herein, the openings in the top layer can be the same (diameter) as those in the bottom layer. Or they can be larger than those in the bottom layer than the top layer. For "tapered" openings, the same can be true at the interface of the two layers. In other words, the ratio of the relative diameters of the openings in the two layers can be greater than 1, equal to 1, or less than 1.

Figure 5A:
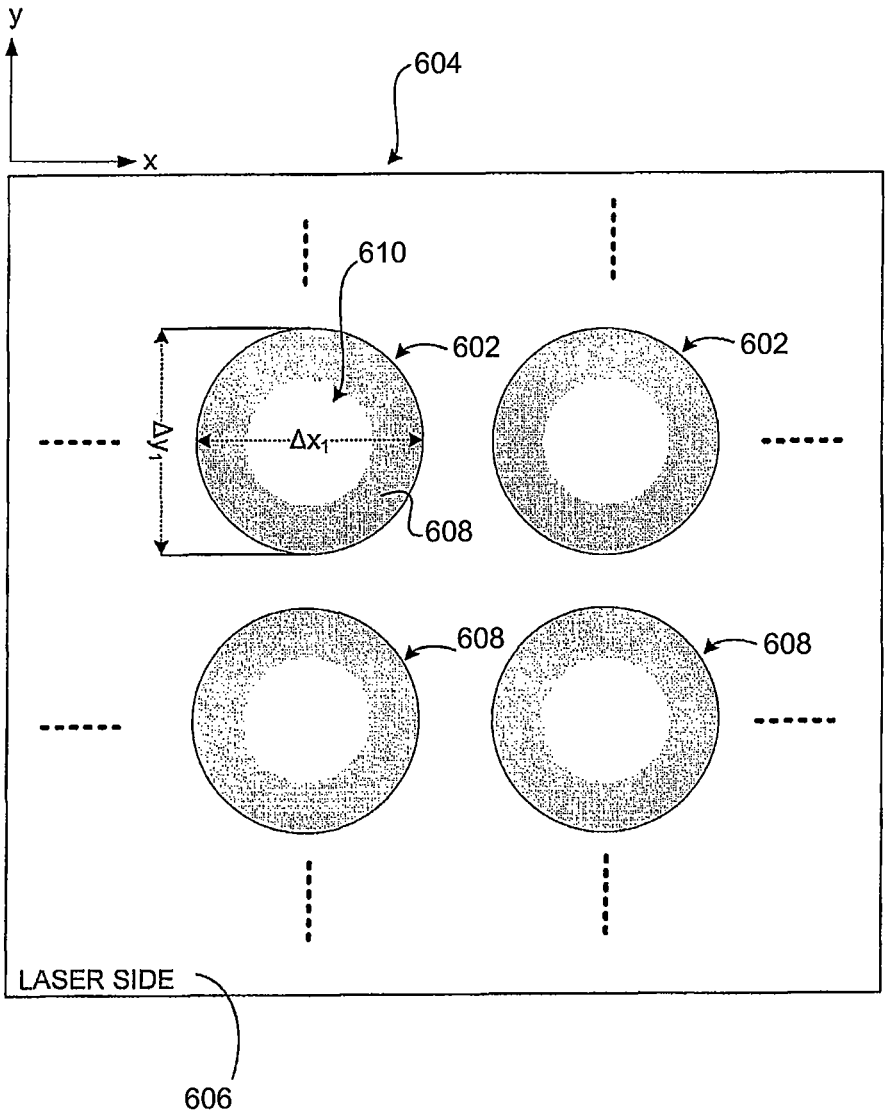
FIG. 5A illustrates a plan view of a plurality of openings in the extruded top layer according to an embodiment.
Figure 5B:
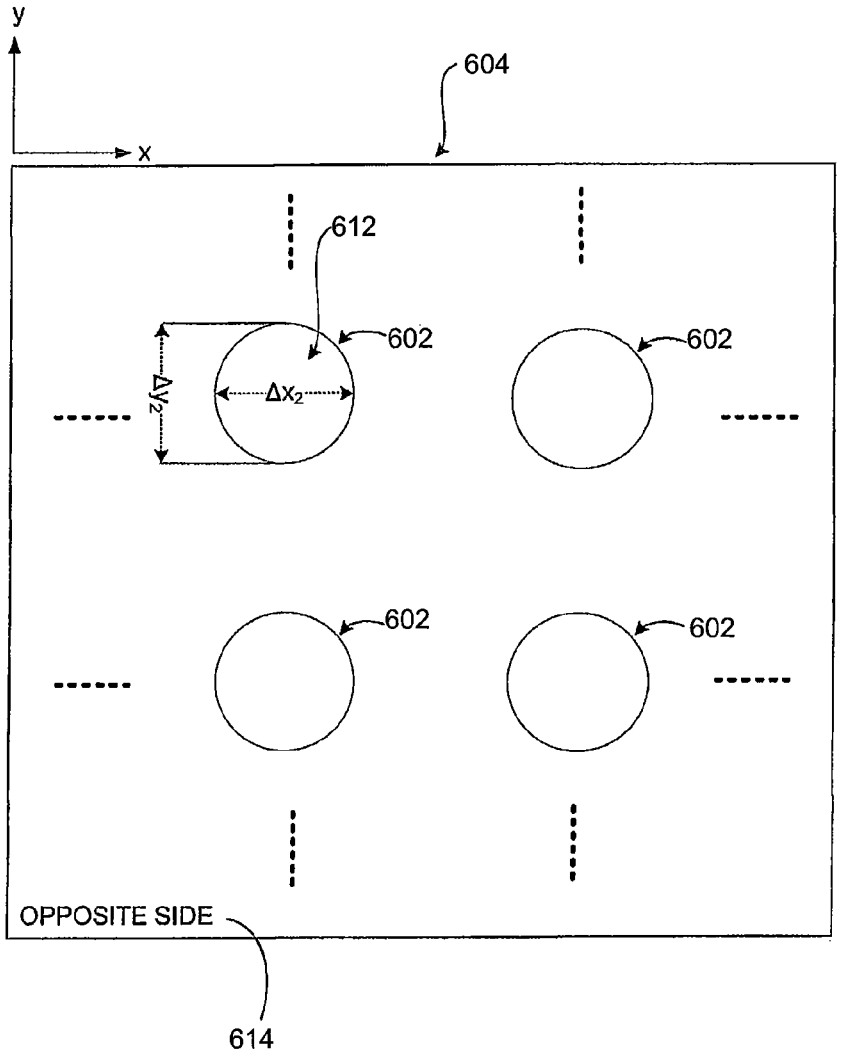
FIG. 5B illustrates a plan view of a plurality of openings in the extruded top layer according to an embodiment.

FIGS. 5A and 5B illustrate a plan view of a plurality of openings 102 that are produced in an at least one extruded top layer 604 in accordance with another exemplary embodiment. The creation of openings as described below is described in U.S. Pat. No. 8,454,800, the entirety of which is incorporated by reference hereby. According to one aspect, FIG. 5A shows the plurality of openings 602 from the perspective of a top surface 606 that faces a laser source (not shown), whereby the laser source is operable to create the openings in the extruded layer 604. Each opening 606 may have a conical shape, where the inner surface 608 of each opening 602 tapers inwardly from the opening 610 on the top surface 606 through to the opening 612 (FIG. 5B) on the bottom surface 614 of at least one extruded layer 604 of the belt. The diameter along the x-coordinate direction for opening 610 is depicted as $\Delta x1$ while the diameter along the y-coordinate direction for opening 610 is depicted as $\Delta y1$. Referring to FIG. 5B, similarly, the diameter along the x-coordinate direction for opening 612 is depicted as $\Delta x2$ while the diameter along the y-coordinate direction for opening 612 is depicted as $\Delta y2$. As is apparent from FIGS. 5A and 5B, the diameter $\Delta x1$ along the x-direction for the opening 610 on the top side 606 of belt 604 is larger than the diameter $\Delta x2$ along the x-direction for the 612 on the bottom side 614 of the at least one extruded layer 604 of the belt. Also, the diameter $\Delta y1$ along the y-direction for the opening 610 on the top side 606 of fabric 604 is larger than the diameter $\Delta y2$ along the y-direction for the opening 612 on the bottom side 614 of belt 604.

Figure 6:
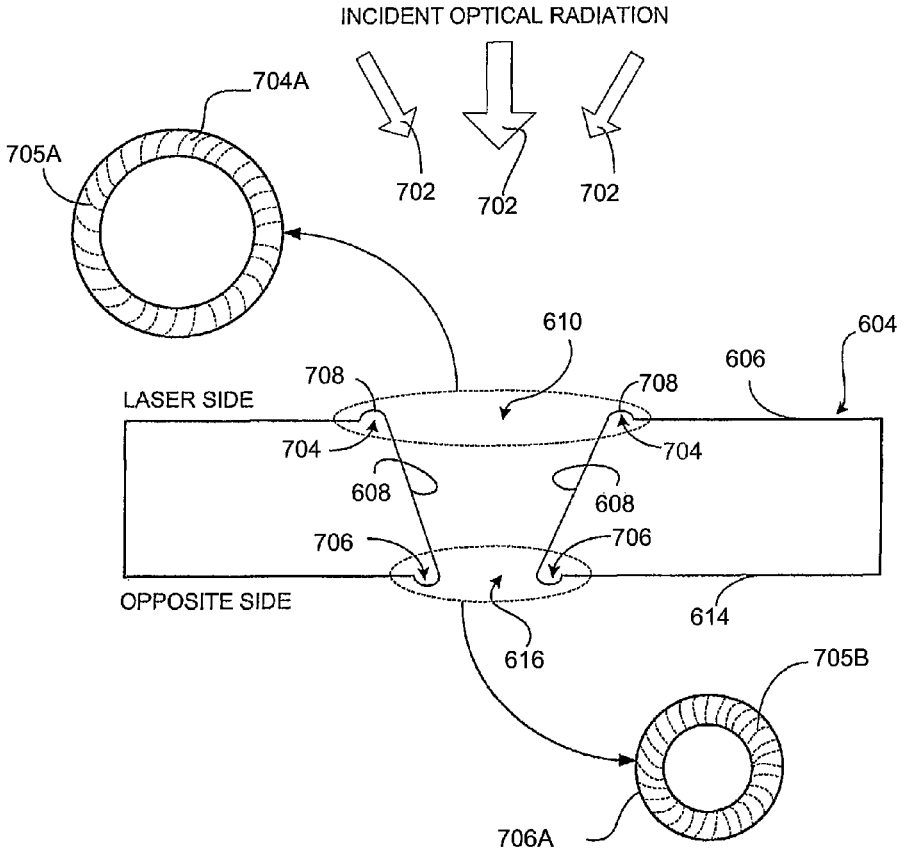
FIG. 6 illustrates a cross-sectional view of one of the openings depicted in FIGS. 5A and 5B.

FIG. 6A illustrates a cross-sectional view of one of the openings 602 depicted in FIGS. 5A and 5B. As previously described, each opening 602 may have a conical shape, where the inner surface 608 of each opening 602 tapers inwardly from the opening 610 on the top surface 606 through to the opening 612 on the bottom surface 614 of the at least one extruded layer 604 of the belt. The conical shape of each opening 602 may be created as a result of incident optical radiation 702 generated from an optical source such as a CO2 or other laser device. By applying laser radiation 702 of appropriate characteristics (e.g., output power, focal length, pulse width, etc.) to, for example, the extruded monolithic material as described herein, an opening 602 may be created as a result of the laser radiation perforating the surfaces 606, 614 of the belt 604. Conversely, the conical shaped opening may be such that the smaller diameter is on the sheet contact surface and the larger diameter is on the opposite surface. The creation of openings using laser devices is described in U.S. Pat. No. 8,454,800, the entirety of which is incorporated by reference hereby.

As illustrated in FIG. 6A, according to one aspect, the laser radiation 202 may create a first uniformly raised, continuous edge or ridge 704 on the top surface 706 and, if desired, a second uniformly raised, continuous edge or ridge 706 on the bottom surface 614 of the at least one extruded layer 604 of the belt. These raised edges 704, 706 may also be referred to as a raised rim or lip. A plan view from the top for raised edge 704 is depicted by 704A. Similarly, a plan view from the bottom for raised edge 706 is depicted by 706A. In both depicted views 704A and 706A, dotted lines 705A and 705B are graphical representations illustrative of a raised rim or lip. Accordingly, dotted lines 705A and 705B are not intended to represent striations. The height of each raised edge 704, 706 may be in the range of 5-10 μm, measured from the layer's surface. The height is calculated as the level difference between surface of the belt and the top portion of the raised edge. For example, the height of raised edge 704 is measured as the level difference between surface 606 and top portion 708 of raised edge 604. Raised edges such as 704 and 706 provide, among other advantages, local mechanical reinforcement for each opening which in turn contributes to the global resistance to deformation of a given extruded perforated layer in a creping belt. Also, deeper openings result in larger domes in the tissue produced, and also result in, for example, more sheet bulk and lower density. It is to be noted that $\Delta x1/\Delta x2$ may be 1.1 or higher and $\Delta y1/\Delta y2$ may be 1.1 or higher in all cases. Alternatively, in some or all cases, $\Delta x1/\Delta x2$ may be equal to 1 and $\Delta y1/\Delta y2$ may be equal to 1, thereby forming openings of a cylindrical shape.

While the creation of openings having raised edges in a fabric may be accomplished using a laser device, it is envisaged that other devices capable of creating such effects may also be employed. Mechanical punching or embossing then punching may be used. For example, the extruded polymeric layer may be embossed with a pattern of protrusions and corresponding depressions in the surface in the required pattern. Then each protrusion for example may be mechanically punched or laser drilled. Further, the raised rims, regardless of the technique used to make the opening, may be on all the openings, or only on those selected or desired.

When used as the extruded top layer of a multilayer belt, it may be desirable to only have the raised rims around the openings on the sheet contact surface, as the raised rims on the opposite surface that is adjacent to the woven fabric may interfere with good bonding of the two layers together.

The layers of the multilayer belt according to the embodiments may be joined together in any manner that provides a durable connection between the layers to allow the multilayer belt to be used in a tissue making process. In some embodiments, the layers are joined together by a chemical means, such as using an adhesive. In still other embodiments, the layers of the multilayer belt may be joined by techniques such as heat welding, ultrasonic welding, and laser fusion, using laser absorptive additives or not. Those skilled in the art will appreciate the numerous lamination techniques that could be used to join the layers described herein to form the multilayer belt.

While the multilayer belt embodiments depicted in FIGS. 4A, 4B, 5A, and 5B and FIG. 6 includes or refers to two distinct layers, in other embodiments, an additional layer may be provided between the top and bottom layers shown in the figures. For example, an additional layer could be positioned between the top and bottom layers described above in order to provide a further semipermeable barrier that prevents cellulose fibers from being pulled all the way through the belt structure. In other embodiments, the means employed for connecting the top and bottom layers together may be constructed as a further layer. For example, a two-sided adhesive tape layer might be a third layer that is provided between the top layer and the bottom layer.

The total thickness of the multilayer belt according to the embodiments may be adjusted for the particular tissue making machine and process in which the multilayer belt is to be used. In some embodiments, the total thickness of the belt is from about 0.5 cm to about 2.0 cm. In embodiments that include a woven fabric bottom layer, the extruded polymeric top layer can provide the majority of the total thickness of the multilayer belt In embodiments that include a woven fabric bottom layer, the woven base fabric can have many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a tissue making machine as described herein, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

As noted above in embodiments the extruded polymeric top layer (and any additional layers) can be made from a plurality of sections that are abutted and joined together in a side to side fashion—either spiral wound or a series of continuous loops—and the abutting edges joined using different techniques.

The extruded top layer can be made with any of these extruded polymeric materials mentioned above, amongst others. The extruded polymeric material for these strips and endless loops can be produced from extruded roll goods of given width ranging from 25 mm-1800 mm and caliper (thickness) ranging from 0.10 mm to 3.0 mm or more. For the parallel endless loops, rolled sheet is unwound and creating a butt joint or lap joint creating a CD seam at the appropriate loop length for the finished belt. The loops are then placed side by side so that the adjacent edges of two loops abut. Any edge preparation (skiving etc.) is done before the edges are placed side by side. Geometric edges (bevels, mirror images, etc.) may be produced when the material is extruded. The edges are then joined using techniques already described herein. The number of loops needed is determined by the width of the material roll, and the width of the final belt.

As discussed above, an advantage of the multilayer belt structure is that the strength, stretch resistance, dimensional stability and durability of the belt can be provided by one of the layers, while the other layer may not significantly contribute to these parameters. The durability of the multilayer belt materials of embodiments as described herein was compared to the durability of other potential belt making materials. In this test, the durability of the belt materials was quantified in terms of the tear strength of the materials. As will be appreciated by those skilled in the art, the combination of both good tensile strength and good elastic properties results in a material with high tear strength. The tear strength of seven candidate extruded samples of the top and bottom layer belt materials described above was tested. The tear strength of a structuring fabric used for creping operations was also tested. For these tests, a procedure was developed based, in part, on ISO 34-1 (Tear Strength of Rubber, Vulcanized or Thermoplastic-Part 1: Trouser, Angle and Crescent). An Instron® 5966 Dual Column Tabletop Universal Testing System by Instron Corp. of Norwood, Mass. and BlueHill 3 Software also by Instron Corp. of Norwood, Mass., were used. All tear tests were conducted at 2 in./min (which differs from ISO 34-1 which uses a 4 in./min rate) for a tear extension of 1 in. with an average load being recorded in pounds.

The details of the samples and their respective MD and CD Tear strengths are shown in TABLE 3. Note that a designation of "blank" for a sample indicates that the sample was not provided with openings, whereas the designation "prototype" means that the sample had not yet been made into an endless belt structure, but rather, was merely the belt material in a test piece.

TABLE 3

| Sample | Composition | MD Tear Strength (Average Load, lbf) | CD Tear Strength (Average Load, lbf) |
|---|---|---|---|
| 1 | 0.70 mm PET (blank) | 9.43 | 5.3 |
| 2 | 0.70 mm PET (prototype) | 8.15 | 7.36 |

TABLE 3-continued

| Sample | Composition | MD Tear Strength (Average Load, lbf) | CD Tear Strength (Average Load, lbf) |
|---|---|---|---|
| 3 | 1.00 mm HYTREL ® (blank) | 20.075 | 19.505 |
| 4 | 0.50 mm PET (blank) | 3.017 | 2.04 |
| 5 | Fabric A | 20.78 | 16.26 |
| 6 | Fabric B | 175 | 175 |

As can be seen from the results shown in TABLE 3, the woven fabrics and the extruded HYTREL® material had much greater tear strengths than the extruded PET polymeric materials. As described above, in embodiments using a woven fabric or an extruded HYTREL® material layer used to form one of the layers of the multilayer belt, the overall tear strength of the multilayer belt structure will be at least as strong as any of the layers. Thus, multilayer belts that include a woven fabric layer or an extruded HYTREL® layer will be imparted with good tear strength regardless of the material used to form the other layer or layers.

As noted above, embodiments can include an extruded polyurethane top layer and a woven fabric bottom layer. As described below, the MD tear strength of such combinations was evaluated, and also compared to the MD tear strength of a woven structuring fabric used in a creping operation. The same testing procedure was used as with the above-described tests. In this test, Sample 1 was a two-layer belt structure with a 0.5 mm thick top layer of extruded polyurethane having 1.2 mm openings. The bottom layer was a woven J5076 fabric made by Albany International Corp., the details of which can be found above. Sample 2 was a two-layer belt structure with a 1.0 mm thick top layer of extruded polyurethane having 1.2 mm openings and J5076 fabric as the bottom layer. The tear strength of the J5076 fabric by itself was also evaluated as Sample 3. The results of these tests are shown in TABLE 4.

TABLE 4

| Sample | MD Tear Strength (average load, lbf) |
|---|---|
| 1 | 12.2 |
| 2 | 15.8 |
| 3 | 9.7 |

As can be seen from the results in TABLE 4, the multilayer belt structure with an extruded polyurethane top layer and a woven fabric bottom layer had excellent tear strength. When considering the tear strength of the woven fabric alone, it can be seen that the woven fabric produced a majority of the tear strength of the belt structures. The extruded polyurethane layer provided proportionally less tear strength of the multilayer belt structure. Nevertheless, while an extruded polyurethane layer by itself may not have sufficient strength, stretch resistance as well as durability, in terms of tear strength, as indicated by the results in TABLE 4, when a multilayer structure is used with an extruded polyurethane layer and a woven fabric layer, a sufficiently durable belt structure can be formed.

TABLE 5 shows the properties of eight examples of multilayer belts that were constructed according to the invention. Belts 1 and 2 had two polymeric layers of PET for its structure. Belts 3 to 8 had top layers formed from polyurethane (PUR), and bottom layers formed from the PET fabric J5076 fabric made by Albany International (described above). TABLE 5 sets forth properties of the openings in the top layer (i.e., the "sheet side") of each belt, such as the cross-sectional areas, volumes of the openings, and angles of the sidewalls of the openings. Table 5 also sets forth properties of the openings in the bottom layer (i.e., the "air side").

TABLE 5

| Property | BELT 1 (top layer) | BELT 1 (bottom layer) | BELT 2 (top layer) | BELT 2 (bottom layer) | BELT 3 | BELT 4 | BELT 5 | BELT 6 | BELT 7 | BELT 8 |
|---|---|---|---|---|---|---|---|---|---|---|
| Top Layer Material | PET | — | PUR | — | PUR | PUR | PUR | PUR | PUR | PUR |
| Bottom Layer Material | — | PET | — | PET | Fabric | Fabric | Fabric | Fabric | Fabric | Fabric |
| Sheet Side Hole CD Diameter (mm) | 2.41 | 0.65 | 2.50 | 0.69 | 2.40 | 2.53 | 2.54 | 3.00 | 1.43 | 1.65 |
| Sheet Side Hole MD Diameter (mm) | 2.41 | 0.63 | 2.50 | 0.69 | 2.40 | 2.53 | 2.64 | 3.00 | 1.62 | 1.67 |
| Sheet Side Hole CD/MD | 1.0 | 1.0 | 1.0 | 1.0 | 1.0 | 1.0 | 1.0 | 1.0 | 0.9 | 1.0 |
| Sheet Side Hole Cross-Sectional Area ($mm^2$) | 4.57 | 0.32 | 4.91 | 0.37 | 4.53 | 5.02 | 5.27 | 7.07 | 1.81 | 2.17 |
| Sheet Side Hole % Open Area | 73.6 | 64.1 | 82.7 | 64.5 | 80.0 | 66.9 | 67.5 | 79.3 | 79.3 | 76.4 |
| Air Side Hole CD Diameter (mm) | 1.91 | 0.35 | 2.08 | 0.36 | 2.0 | 1.96 | 1.98 | 2.41 | 1.04 | 1.07 |
| Air Side Hole MD Diameter (mm) | 1.91 | 0.35 | 2.08 | 0.36 | 2.0 | 1.96 | 1.98 | 2.41 | 1.13 | 1.07 |
| Air Side Hole CD/MD | 1.0 | 1.0 | 1.0 | 1.0 | 1.0 | 1.0 | 1.0 | 1.0 | 0.9 | 1.0 |
| Air Side Hole Cross-Sectional Area ($mm^2$) | 2.85 | 0.10 | 3.41 | 0.10 | 3.14 | 3.03 | 3.08 | 4.57 | 0.92 | 0.89 |
| Air Side Hole % Open Area | 45.9 | 19.0 | 57.4 | 17.3 | 55.5 | 40.4 | 42.9 | 43.7 | 40.3 | 31.5 |
| Sheet Side/Air Side Area Ratio | 1.6 | 3.4 | 1.4 | 3.7 | 1.4 | 1.7 | 1.7 | 1.5 | 2.0 | 2.4 |
| Side Wall Angle CD 1 (deg) | 69.0 | 73.1 | 67 | 72 | 68.1 | 74.3 | 74.4 | 78.9 | 66.4 | 75.1 |
| Side Wall Angle CD 2 (deg) | 69.0 | 73.1 | 67 | 72 | 68.1 | 74.3 | 74.4 | 78.9 | 71.5 | 72.4 |

TABLE 5-continued

| Property | BELT 1 (top layer) | BELT 1 (bottom layer) | BELT 2 (top layer) | BELT 2 (bottom layer) | BELT 3 | BELT 4 | BELT 5 | BELT 6 | BELT 7 | BELT 8 |
|---|---|---|---|---|---|---|---|---|---|---|
| Side Wall Angle MD 1 (deg) | 69.0 | 73.1 | 70 | 72 | 68.1 | 74.3 | 71.7 | 78.9 | 63.9 | 73.2 |
| Side Wall Angle MD 2 (deg) | 69.0 | 73.1 | 65 | 72 | 68.1 | 74.3 | 71.7 | 78.9 | 63.9 | 73.2 |
| Volume of Openings in Top Layer ($mm^3$) | 2.60 | 0.11 | 2.18 | 0.13 | 2.01 | 4.27 | 4.63 | 8.66 | 0.76 | 1.66 |
| % Material Removed From Top Layer | 83.6 | 44.1 | 73.5 | 43.8 | 71.1 | 57.0 | 64.4 | 55.2 | 66.6 | 58.6 |
| MD Land Distance (mm) | 1.64 | 0.79 | 2.17 | 0.11 | 2.14 | 2.68 | 2.35 | 2.98 | 0.17 | 1.42 |
| MD Land/MD Diameter Ratio (%) | 67.9 | 125.7 | 86.8 | 16.5 | 89.3 | 105.9 | 89.1 | 99.2 | 10.3 | 84.8 |
| CD Land Distance | 0.65 | 0.06 | 0.04 | 0.75 | 0.09 | 0.35 | 0.34 | 0.50 | 1.14 | 0.19 |
| CD Land/CD Dia. Ratio % | 27.3 | 8.48 | 1.73 | 109.25 | 3.75 | 13.95 | 13.38 | 16.79 | 79.41 | 11.24 |
| 1/width (columns/cm) | 3.26 | 14.12 | 3.93 | 6.97 | 4.02 | 3.47 | 3.47 | 2.85 | 3.90 | 5.44 |
| 1/height (rows/cm) | 4.94 | 14.12 | 4.28 | 25.04 | 4.40 | 3.84 | 4.00 | 3.85 | 11.22 | 6.48 |
| Holes per $cm^2$ | 16 | 199 | 17 | 174 | 18 | 13 | 14 | 10 | 44 | 35 |

INDUSTRIAL APPLICABILITY

The machines, devices, belts, fabrics, processes, materials, and products described herein can be used for the production of commercial products, such as facial or toilet tissue and towels.

Although embodiments of the present invention and modifications thereof have been described in detail herein, it is to be understood that this invention is not limited to these precise embodiments and modifications, and that other modifications and variations may be effected by one skilled in the art without departing from the spirit and scope of the invention as defined by the appended claims.

Each patent, patent application, and publication cited or described in the present application is hereby incorporated by reference in its entirety as if each individual patent, patent application, or publication was specifically and individually indicated to be incorporated by reference.

The invention claimed is:

1. A permeable belt for creping or structuring a web in a tissue making process, the belt comprising:

a first layer formed from an extruded polymeric material, the first layer providing a first outside surface of the belt on which a nascent tissue web is deposited, and the first layer having a plurality of openings extending therethrough, with the plurality of openings having an average cross-sectional area on the plane of the first surface of at least about 0.1 $mm^2$; and a second layer attached to the first layer, the second layer forming a second outside surface of the belt, and the second layer having a plurality of openings extending therethrough.

2. The belt according to claim 1, wherein the first layer comprises a thermoplastic elastomer and the second layer is a woven fabric.

3. The belt according to claim 2, wherein the plurality of openings in the first layer has an average cross-sectional area from about 1.5 $mm^2$ to about 8.0 $mm^2$ in the plane of the first surface.

4. The belt according to claim 2, wherein the woven fabric has a permeability of about 200 CFM to about 1200 CFM.

5. The belt according to claim 2, wherein the openings of the second layer have a diameter of about 100 to about 700 microns.

6. The belt according to claim 2, wherein the first layer is an extruded monolithic layer comprising a thermoplastic elastomer formed from a thermoplastic elastomer selected from: a polyester based thermoplastic elastomer (TPE), a nylon based TPE and a thermoplastic polyurethane (TPU) elastomer.

7. The belt according to claim 1, wherein the plurality of openings through the first layer has an average cross-sectional area from about 0.1 $mm^2$ to about 11.0 $mm^2$ in the plane of the first surface.

8. The belt according to claim 1, wherein the first layer is an extruded monolithic layer comprising a thermoplastic elastomer formed from a thermoplastic elastomer selected from: a polyester based thermoplastic elastomer (TPE), a nylon based TPE and a thermoplastic polyurethane (TPU) elastomer.

9. The belt according to claim 8, wherein the thermoplastic elastomer comprises a polyester based TPE.

10. The belt according to claim 9, wherein the polyester based TPE comprises a polyester based TPE selected from the group of: HYTREL® (polyester thermoplastic elastomer), Arnitel® (thermoplastic copolyester based elastomer), Riteflex® (thermoplastic polyester elastomer), and Pibiflex® (thermoplastic copolyester elastomer).

11. The belt according to claim 8, wherein the nylon based TPE comprises a nylon based TPE selected from the group of: Pebax® (medical-grade thermoplastic elastomer), Vetsamid-E® (block copolymer comprising polyamide 12 segments and polyether segments), Grilon® (thermoplastic polyamide based on polyamide 6 and polyamide 66)/Grilamid® (thermoplastic polyamide).

12. The belt according to claim 8, wherein the TPU elastomer comprises a TPU elastomer selected from the group of Estane® (polyester based thermoplastic polyurethane), Pearlthane® (polycaprolactone copolyester-based thermoplastic polyurethane), Elastollan® (thermoplastic polyurethane elastomer), Desmopan® (thermoplastic block copolymer), and Pellethane® (polyester polycaprolactone based polyurethane elastomer).

13. The belt according to claim 1, wherein the openings of the second layer have a diameter of about 100 to about 700 microns.

14. A belt as in claim 1, wherein the first layer is attached to the second layer by using an adhesive, heat fusion, ultrasonic welding, or laser welding.

15. The belt according to claim 1, wherein the first layer is an extruded polymeric layer, and the second layer is an extruded polymeric layer.

16. The belt according to claim 15, wherein the first layer is a monolithic layer formed from polyurethane, and the second layer is a monolithic layer formed from a thermoplastic polymer.

17. The belt according to claim 16, wherein the first layer is a monolithic layer formed from polyurethane, and the second layer is a monolithic layer formed from polyethylene terephthalate.

18. The belt according to claim 16, wherein the first layer is a monolithic layer formed from polyurethane, and the second layer is a monolithic layer formed from HYTREL® (polyester thermoplastic elastomer).

19. The belt according to claim 1, wherein the first surface has a dynamic coefficient of friction of about 0.5 to about 2.

20. The belt according to claim 19, wherein the first surface has a coefficient of friction of about 0.7 to about 1.3.

21. The belt of claim 1, wherein the second layer comprises an array of MD yarns.

22. The belt of claim 1, wherein the second layer is a nonwoven layer comprising a polymeric material selected from the group consisting of: aramid fiber, polyesters, and polyamides.

23. The belt according to claim 1, wherein the plurality of openings of the second layer have a smaller cross-sectional area adjacent to an interface between the first layer and the second layer than the cross-sectional area of the plurality of openings of the first layer adjacent to the interface between the first layer and the second layer.

24. The belt according to claim 1, wherein the plurality of openings of the second layer have a larger cross-sectional area adjacent to an interface between the first layer and the second layer than the cross-sectional area of the plurality of openings of the first layer adjacent to the interface between the first layer and the second layer.

25. The belt according to claim 1, wherein the plurality of openings of the second layer have the same cross-sectional area adjacent to an interface between the first layer and the second layer as the cross-sectional area of the plurality of openings of the first layer adjacent to the interface between the first layer and the second layer.

26. A permeable belt for creping or structuring a web in a tissue making process, the belt comprising:

a first layer formed from an extruded polymeric material, the first layer providing a first surface of the belt, and the first layer having a plurality of openings extending therethrough, with the plurality of openings having a volume of at least about 0.05 $mm^3$, and at least one uniformly raised continuous edge being formed around at least one of the plurality of openings; and a second layer attached to the first layer at an interface, the second layer providing a second surface of the belt, and the second layer being formed from a woven fabric having a permeability of at least about 200 CFM.

27. The belt according to claim 26, wherein the woven fabric has a permeability of about 200 CFM to about 1200 CFM.

28. The belt according to claim 26, wherein the woven fabric has a permeability of about 300 CFM to about 900 CFM.

29. The belt according to claim 26, wherein the plurality of openings in the first layer has a volume of about 0.05 $mm^3$ to about 11 $mm^3$.

30. The belt according to claim 26 wherein the plurality of openings in the first layer has a volume of at least 0.25 $mm^3$.

31. The belt according to claim 26, wherein the extruded polymeric material comprises a thermoplastic elastomer (TPE) comprising a polyester based TPE.

32. The belt according to claim 31, wherein the polyester based TPE comprises a polyester based TPE selected from the group of HYTREL® (polyester thermoplastic elastomer), Arnitel® (thermoplastic copolyester based elastomer), Riteflex® (thermoplastic polyester elastomer), and Pibiflex® (thermoplastic copolyester elastomer).

33. The belt according to claim 26, wherein the polymeric material comprises a thermoplastic elastomer comprising a thermoplastic polyurethane (TPU) elastomer.

34. The belt according to claim 33, wherein the TPU elastomer comprises a TPU elastomer selected from the group of Estane® (polyester based thermoplastic polyurethane), Pearlthane® (polycaprolactone copolyester-based thermoplastic polyurethane), Elastollan® (thermoplastic polyurethane elastomer), Desmopan® (thermoplastic block copolymer), and Pellethane® (polyester polycaprolactone based polyurethane elastomer).

35. The belt according to claim 26, wherein the polymeric material comprises a thermoplastic elastomer (TPE) comprising a nylon based TPE.

36. The belt according to claim 35, wherein the nylon based TPE comprises a nylon based TPE selected from the group of: Pebax® (medical-grade thermoplastic elastomer), Vetsamid-E® (block copolymer comprising polyamide 12 segments and polyether segments), Grilon® (thermoplastic polyamide based on polyamide 6 and polyamide 66)/Grilamid® (thermoplastic polyamide).

37. A belt as in claim 26, wherein the first layer is attached to the second layer by using an adhesive, heat fusion, ultrasonic welding, or laser welding.

38. A permeable belt for creping or structuring a web in a tissue making process, the belt comprising:

a first layer formed from an extruded polymeric material, the first layer providing a first outside surface of the belt, and the first layer having a plurality of openings extending therethrough, wherein the first surface (i) provides about 10% to about 65% contact area and (ii) has an opening density of about 10/$cm^2$ to about 80/$cm^2$; and a second layer attached to the first layer, the second layer forming a second outside surface of the belt, and the second layer having a plurality of openings extending therethrough.

39. The belt according to claim 38, wherein the first surface (i) provides about 15% to about 50% contact area and (ii) has an opening density of about 20/$cm^2$ to about 60/$cm^2$.

40. The belt according to claim 39, wherein the first surface (i) provides about 20% to about 40% contact area and (ii) has an opening density of about 25/$cm^2$ to about 35/$cm^2$.

41. The belt according to claim 38, wherein the first layer is an extruded polymeric layer, and the second layer is a woven fabric.

42. The belt according to claim 38, wherein the first layer is an extruded monolithic layer comprising a thermoplastic elastomer formed from a thermoplastic elastomer selected from: a polyester based thermoplastic elastomer (TPE), a nylon based TPE and a thermoplastic polyurethane (TPU) elastomer.

43. The belt according to claim 42, wherein the polyester based TPE comprises a polyester based TPE selected from the group of: HYTREL® (polyester thermoplastic elastomer), Arnitel® (thermoplastic copolyester based elastomer), Riteflex® (thermoplastic polyester elastomer), and Pibiflex® (thermoplastic copolyester elastomer).

44. The belt according to claim 42, wherein the nylon based TPE comprises a nylon based TPE selected from the group of: Pebax® (medical-grade thermoplastic elastomer), Vetsamid-E® (block copolymer comprising polyamide 12 segments and polyether segments), Grilon® (thermoplastic polyamide based on polyamide 6 and polyamide 66)/Grilamid® (thermoplastic polyamide).

45. The belt according to claim 42, wherein the TPU elastomer comprises a TPU elastomer selected from the group of Estane® (polyester based thermoplastic polyurethane), Pearlthane® (polycaprolactone copolyester-based thermoplastic polyurethane), Elastollan® (thermoplastic polyurethane elastomer), Desmopan® (thermoplastic block copolymer), and Pellethane® (polyester polycaprolactone based polyurethane elastomer).

46. The belt according to claim 38, wherein the first layer is an extruded polymeric layer, and the second layer is an extruded polymeric layer.

47. The belt according to claim 46, wherein the first layer is a monolithic layer formed from polyurethane, and the second layer is a monolithic layer formed from a thermoplastic polymer.

48. The belt according to claim 38, wherein the plurality of openings of the second layer have a smaller cross-sectional area adjacent to an interface between the first layer and the second layer than the cross-sectional area of the plurality of openings at the surface of the first layer adjacent to the interface between the first layer and the second layer.

49. The belt according to claim 38, wherein the plurality of openings of the second layer have a larger cross-sectional area adjacent to an interface between the first layer and the second layer than the cross-sectional area of the plurality of openings at the surface of the first layer adjacent to the interface between the first layer and the second layer.

50. The belt according to claim 38, wherein the plurality of openings of the second layer have the same cross-sectional area adjacent to an interface between the first layer and the second layer than the cross-sectional area of the plurality of openings at the surface of the first layer adjacent to the interface between the first layer and the second layer.

51. A belt as in claim 38, wherein the first layer is attached to the second layer by using an adhesive, heat fusion, ultrasonic welding, or laser welding.

* * * * *